US005579886A

United States Patent [19]

Ishida et al.

[11] Patent Number: 5,579,886

[45] Date of Patent: Dec. 3, 1996

[54] COIN PROCESSOR

[75] Inventors: Takeshi Ishida, Sakado; Kenji Koyama, Kawagoe; Iwao Kanasashi, Ageo; Jun Yamada, Turugashima; Genzo Yoshizawa, Tokyo, all of Japan

[73] Assignee: Kabushiki Kaisha Nippon Conlux, Japan

[21] Appl. No.: 321,219

[22] Filed: Oct. 11, 1994

[30] Foreign Application Priority Data

| | | | |
|---|---|---|---|
| Oct. 21, 1993 | [JP] | Japan | 5-263819 |
| Oct. 22, 1993 | [JP] | Japan | 5-265070 |
| Oct. 22, 1993 | [JP] | Japan | 5-265071 |

[51] Int. Cl.[6] ..... G07F 3/02

[52] U.S. Cl. ..... 194/202; 194/217; 194/241; 194/346

[58] Field of Search ..... 194/202, 203, 194/216, 217, 218, 241, 317, 318, 346

[56] References Cited

U.S. PATENT DOCUMENTS

| | | | |
|---|---|---|---|
| 3,797,628 | 3/1974 | Fougere et al. . | |
| 3,896,915 | 7/1975 | Hayashi et al. . | |
| 3,948,377 | 4/1976 | Hayashi et al. . | |
| 3,998,309 | 12/1976 | Mandas et al. | 194/203 |
| 4,091,908 | 5/1978 | Hayashi et al. . | |
| 4,105,105 | 8/1978 | Braum | 194/346 X |
| 4,106,610 | 8/1978 | Heiman . | |
| 4,108,296 | 8/1978 | Hayashi et al. . | |
| 4,124,111 | 11/1978 | Hayashi . | |
| 4,250,905 | 2/1981 | Kobayashi et al. . | |
| 4,257,435 | 3/1981 | Tanaka et al. | 194/203 X |
| 4,347,924 | 9/1982 | Hayashi et al. . | |
| 4,374,529 | 2/1983 | Kobayashi et al. . | |
| 4,385,684 | 5/1983 | Sugimoto et al. . | |
| 4,392,505 | 7/1983 | Maloney et al. . | |
| 4,432,447 | 2/1984 | Tanaka . | |
| 4,436,196 | 3/1984 | Crisp et al. . | |
| 4,462,513 | 7/1984 | Dean et al. . | |
| 4,491,140 | 1/1985 | Eglise et al. . | |
| 4,493,411 | 1/1985 | Heiman . | |
| 4,538,719 | 9/1985 | Gray et al. . | |
| 4,546,869 | 10/1985 | Dean et al. . | |
| 4,601,380 | 7/1986 | Dean et al. . | |
| 4,607,650 | 8/1986 | Kobayashi et al. . | |
| 4,616,323 | 10/1986 | Hayashi . | |
| 4,625,851 | 12/1986 | Johnson et al. . | |
| 4,646,904 | 3/1987 | Hoormann . | |
| 4,660,705 | 4/1987 | Kai et al. . | |
| 4,674,618 | 6/1987 | Eglise et al. . | |
| 4,705,154 | 11/1987 | Masho et al. . | |
| 4,706,202 | 11/1987 | Kobayashi et al. . | |
| 4,763,769 | 8/1988 | Levasseur . | |
| 4,842,119 | 6/1989 | Abe . | |
| 4,926,996 | 5/1990 | Eglise et al. . | |
| 4,995,497 | 2/1991 | Kai et al. . | |
| 5,033,603 | 7/1991 | Kai et al. . | |
| 5,050,719 | 9/1991 | Shimizu | 194/202 |
| 5,112,275 | 5/1992 | Sato . | |
| 5,184,708 | 2/1993 | Levasseur . | |
| 5,219,059 | 6/1993 | Furuya et al. . | |
| 5,366,058 | 11/1994 | Kurosu | 194/202 |

*Primary Examiner*—Karen B. Merritt
*Assistant Examiner*—Scott L. Lowe
*Attorney, Agent, or Firm*—Greer, Burns & Crain, Ltd.

[57] ABSTRACT

In a case where a succeeding coin has arrived at a coin discriminator (110) before a preceding coin passed through the coin discriminator (110) arrives at a disposition position of a true/false coin distributor (120), the true/false coin distributor (120) is shifted to a false coin side to distribute both of the preceding and succeeding coins to the false coin side. When the preceding coin passed through the coin discriminator (110) is true one and if the succeeding coin has already arrived at the coin discriminator (110) immediately after passage of the preceding coin through the true/false coin distributor (120), the true/false coin distributor (120) is shifted to the false coin side to distribute only the succeeding coin to the false coin side. When the preceding coin passed through the coin discriminator (110) is false one and if the succeeding coin has arrived at the coin discriminator (110) before the preceding coin passes through the true/false coin distributor (120), the true/false coin distributor (120) is shifted to the false coin side to distribute the succeeding coin to the false coin side.

6 Claims, 13 Drawing Sheets

COIN PROCESSOR

BACKGROUND OF THE INVENTION

1. Field of the Invention

The present invention relates to a coin processor which is used for various types of automatic service machines including automatic vending machines and, more particularly, to an improved coin processor which can prevent its erroneous operation when coins are continuously inserted thereinto, which can change the coin pay-out start timing to realize faster payment of coins, or which also can shorten the coin payment time of a coin dispenser which is capable of simultaneous payment of a plurality of sorts or denomenations of coins.

2. Description of the Related Art

In such a coin processor for use in various types of automatic service machines including automatic vending machines, in general, the coin processor first guides a coin inserted through a coin slot to a coin discriminator unit to discriminate whether the inserted coin is a true or false coin and if it is true one, also discriminates its coin sort, and then guides to a true/false coin distributor unit to perform distributing operation between true and false coins.

The coin discriminator unit is configured as, an electronic discriminator for electronically discriminating the inserted coin whether it is a true or false coin and the sort of the inserted coin with use of coin detection coils. The true/false distributor is made up of a true/false coin distributing lever and a true/false coin distributing solenoid for driving the lever, so that when the inserted coin is judged to be a true one by the coin discriminator unit, for example, the true/false coin distributing solenoid is turned ON, whereby the true/false coin distributing lever is shifted to its true coin passage side to guide the coin passed through the coin discriminator to a true coin passage. When the inserted coin is judged to be a false one by the coin discriminator, on the other hand, the true/false coin distributing solenoid remains in its OFF state and thus the true/false distributing lever is in its non-driven state, that is, in its shifted state to its coin return passage side to guide the coin passed through the coin discriminator to a coin return port via the return passage.

The coins guided to the true coin passage are further distributed according to coin sorts, and coins to be used as change are accumulated in coin tubes according to the coin sorts.

With such a coin processor as mentioned above, when a plurality of coins are inserted through the coin slot, it becomes impossible for the machine to carry out its accurate distribution of the inserted coins depending on their coin sorts. And when a false coin is inserted followed by a true coin, the false coin is wrongly guided into the true coin passage.

A recent automatic vending machine system is configured as a function dispersion system in which different units are assigned for respectively different functions. This function dispersion type system includes, for example, a coin mech unit for performing mainly a coin managing operation and a main controller for performing a determining operation of the amount of payment money and managing and controlling operation over its determination command and so on.

In such a function dispersion type system, the coin payment control is carried out so that a command issued from the main controller causes the coin mech unit to be put in its coin payment enable state, whereby when the coin mech unit is put in the coin payment enable state, the main controller transmits a coin payment command to the coin mech unit. When the coin mech unit receives the coin payment command, the coin payment control is shifted to the coin mech unit side and the solenoid and motor for coin payment are driven under the control of the coin mech unit to pay out coins.

With the above-mentioned arrangements, the following configuration (1) and (2) have been conventionally considered for realizing the high speed coin payment.

1) The coin payment motor in the coin mech unit is driven at a higher speed.

2) A plurality of coins are paid at the same time.

However, these methods, which realize direct reduction of the coin payment operational time, both have limitations based on mechanical restrictions in the higher-speed of the coin payment motor of the coin mech unit and in the simultaneous payment of the plurality of coins.

Also, the higher-speed coin payment can be attained also by setting faster the start timing of the coin payment in addition to the direct reduction of the coin payment operational time.

In other words, the time necessary for the coin payment is determined by the total time required by the time elasped from the generation of a coin payment request before start of the coin payment operation of the coin mech unit and the time directly required for the payment operation itself. Though the time directly required for the coin payment operation has a limitation due to the mechanical restrictions, when the time necessary for the coin mech unit to start the coin paying operation is made as short as possible, the higher-speed coin payment can be realized.

A coin mech unit in a prior art automatic vending machine system arranged as the function dispersion type system, in general, includes an acceptor (coin discriminative distributor) for discriminatively distributing inserted coins, coin tubes (coin accumulator) for accumulating ones of the coins distributed by the acceptor to be paid as short change, and a coin mech body (coin accumulator/payer) having a coin payer for paying out coins from the coin tubes. The acceptor and coin mech body are provided with respective controllers, i.e., an acceptor controller and a coin payment controller.

A general arrangement of the prior art automatic vending machine system having such an arrangement as mentioned above is shown in FIG. 14. The illustrated system includes a main controller 10 as a central component, a coin payment controller 20, an article transfer controller 40, a display controller 50, the latter controllers 20, 40, 50 being connected to the main controller 10 through a communication line 60, the coin payment controller 20 being connected with an acceptor controller 30.

In this case, the coin payment controller 20 performs control over the coin mech body, i.e., control of paying out coins from coin tubes, the acceptor controller 30 performs control over an acceptor, i.e., control of discriminating between inserted coins and distributing them, such control information being transmitted from the acceptor controller 30 to the coin payment controller 20. Further, the article transfer controller 40 performs control of transferring or conveying a purchased article, and the display controller 50 performs control of displaying the total money amount of the inserted coins and control of purchaser's selective input of the article to be purchased.

With such an arrangement, when it is desired to pay out change for example, the main controller 10 first transmits a payment set command to the coin payment controller 20 to set the coin payment controller 20 in its coin payment enable state. The main controller 10, when receiving a payment enable notification from the coin payment controller 20 as a response, transmits a payment command to the coin payment controller 20. The coin payment controller 20 in turn, when receiving the payment command from the main controller 10, starts its change paying operation.

In this case, even when the coin payment controller 20 receives the payment set command from the main controller 10, the coin payment controller 20 cannot immediately transmit the payment enable notification to the main controller 10. Because, if a next coin has already been inserted in the acceptor and this coin has not been counted yet at the time the coin payment controller 20 receives the payment set command, and if the coin payment controller 20 transmits the payment enable notification to the main controller 10 at this time point, the main controller shifts to the coin paying operation and thus the coin in question is simply taken by the machine.

Further, if the inserted coin has already been counted but the coin is still in the acceptor when the coin payment controller 20 receives the payment set command, and if the controller 20 has already shifted to its coin paying operation before the coins fall into the coin tubes, coin clogging may take place or lacking of the change may take place when the counted coin is to be used as change,.

In the prior art system, the acceptor is controlled by the acceptor controller 30 and the coin mech body is controlled by the coin payment controller 20 different from the controller 30, so that the acceptor controller 30 can know whether or not coins are present within the acceptor but the coin payment controller 20 cannot know it.

For this reason, this sort of prior art system is arranged so that, taking into consideration the situation when the coins are present within the acceptor, the coin payment controller 20, when receiving the payment set command from the main controller 10, waits by a time necessary for complete dropping of the coins within the acceptor onto the bottoms of the coin tubes, and then transmits the payment enable notification to the main controller 10.

However, when no coins are present within the acceptor, the wait time become unnecessary and leads undesirably to a long time necessary for change coin payment.

Therefore, in various types of automatic service machines including automatic vending machines, for the purpose of shortening the coin payment time, there has been suggested such a coin processor that comprises a coin payment unit for simultaneous payment of a plurality of sorts of coins, i.e., for being able to pay out 2 or more coins in each of a plurality of sorts of coins.

The above coin processor comprising the coin payment unit for allowing simultaneous payment of the plurality of sorts of coins is arranged so that a payment pattern is determined on a higher money sort preferential basis for coin payment.

For example, when it is desired to pay a total of 790 yen of change which consists of one 500 yen coin, two 100 yen coins, one 50 yen coin and four 10 yen coins, if the coin processor comprises a coin payment unit for allowing simultaneous payment of 3 sorts of coins, then this can be carried out through 5 paying operations which follow.

| | | | |
|---|---|---|---|
| First: | 500 yen coin | 100 yen coin | 50 yen coin |
| Second: | 100 yen coin | 10 yen coin | |
| Third: | 10 yen coin | | |
| Fourth: | 10 yen coin | | |
| Fifth: | 10 yen coin | | |

That is, a total of 8 coins including one 500 yen coin, two of 100 yen coins, one 50 yen coin and 4 of 10 yen coins are paid out.

Similarly, when it is desired to pay out 790 yen worth of change which consists of one 500 yen coin, two 100 yen coins, one 50 yen coin and four 10 yen coins, if the coin processor comprises a coin payment unit for allowing simultaneous payment of 2 sorts of coins, then this can be carried out through 6 paying operations which follow.

| | | |
|---|---|---|
| First: | 500 yen coin | 100 yen coin |
| Second: | 100 yen coin | 50 yen coin |
| Third: | 10 yen coin | |
| Fourth: | 10 yen coin | |
| Fifth: | 10 yen coin | |
| Sixth: | 10 yen coin | |

This is, a total of 8 coins including one 500 yen coin, two 100 yen coins, one 50 yen coin and four 10 yen coins are paid out.

However, such a prior art coin processor as mentioned above comprising the coin payment unit for allowing simultaneous payment of the plurality of sorts of coins on the higher coin sort preferential basis has had such a problem that, when it is required to pay many coins of low money sorts for example, the time necessary for the coin payment becomes long.

SUMMARY OF THE INVENTION

It is an object of the present invention to provide an improved coin processor which can eliminate erroneous operation when coins are continuously inserted and also can remove the above disadvantages in the prior art.

Another object of the present invention is to provide a coin processor which can make a time necessary for coin payment as short as possible.

Still another object of the present invention is to provide a coin processor which comprises a coin payment unit capable of simultaneously paying out a plurality of different sorts of coins, in which a time necessary for paying out coins is shortened.

In accordance with an aspect of the present invention, the above objects are attained by a coin processor which comprises coin discrimination means for performing discriminating operation over inserted coins, true/false coin distribution means provided downstream the coin discrimination means for separating, according to a discrimination result of the coin discrimination means, the coins passed through the coin discrimination means into true and false coins, and control means, if a succeeding coin has arrived at the coin discrimination means before a preceding coin passed through the coin discrimination means arrives at a disposition position of the true/false coin distribution means, for shifting the true/false coin distribution means to a false coin side to distribute both of the preceding and succeeding coins to the false coin side.

In accordance with another aspect of the present invention, there is provided a coin processor which comprises coin discrimination means for performing discriminating operation over inserted coins, true/false coin distribution means provided downstream the coin discrimination means for separating, according to a discrimination result of the coin discrimination means, the coins passed through the coin discrimination means into true and false coins, and control means, when a preceding coin passed through the coin discrimination means is a true one and if a succeeding coin has already arrived at the coin discrimination means immediately after the preceding coin has passed through the true/false coin distribution means, for shifting the true/false coin distribution means to a false coin side to distribute the succeeding coin to the false coin side.

In accordance with a further aspect of the present invention, there is provided a coin processor which comprises coin discrimination means for performing discriminating operation over inserted coins, true/false coin distribution means provided downstream the coin discrimination means for separating, according to a discrimination result of the coin discrimination means, the coins passed through the coin discrimination means into true and false coins, and control means, if a succeeding coin has arrived at the coin discrimination means before a preceding coin passed through the coin discrimination means arrives at a disposition position of the true/false coin distribution means, for shifting the true/false coin distribution means to a false coin side to distribute both of the preceding and succeeding coins to the false coin side and, when the preceding coin passed through the coin discrimination means is a true one and if the succeeding coin has already arrived at the coin discrimination means immediately after the preceding coin has passed through the true/false coin distribution means, for shifting the true/false coin distribution means to the false coin side to distribute the succeeding coin to the false coin side.

In accordance with yet another aspect of the present invention, there is provided a coin processor which comprises coin discrimination means for performing discriminating operation over inserted coins, true/false coin distribution means provided downstream the coin discrimination means for separating, according to a discrimination result of the coin discrimination means, the coins passed through the coin discrimination means into true and false coins, and control means, when a preceding coin passed through the coin discrimination means is a false one and if a succeeding coin has arrived at the coin discrimination means before the preceding coin passes through the true/false coin distribution means, for shifting the true/false coin distribution means to a false coin side to distribute the succeeding coin to the false coin side.

In accordance with yet a further aspect of the present invention, there is provided a coin processor which comprises a coin discriminator/distributor for performing discriminating operation over inserted coins and performing distributing operation according to sorts of the inserted coins, a coin accumulator/payer for accumulating the coins distributed by the coin discriminator/distributor in coin accumulators and performing coin paying operation on the basis of coins accumulated in the coin accumulators, main controller for calculating a coin payment amount to be paid out from the coin accumulator/payer and transmitting a coin payment set command to set the coin discriminator/distributor and the coin accumulator/payer in a coin payment state, judgement means, when receiving the coin payment set command, for judging the presence or absence of a coin within the coin discriminator/distributor, and coin payment control means, when the judgement means judges the absence of the coin within the coin discriminator/distributor, for immediately paying out coins corresponding to the coin payment amount calculated by the main controller and, when the judgement means judges the presence of the coin within the coin discriminator/distributor, for paying out coins corresponding to the coin payment amount calculated by the main controller after the coin present within the coin discriminator/distributor has passed through the coin discriminator/distributor.

In the present invention, in place of the payment based on the higher-value coin sort priority, coins of a sort corresponding to maximum one of the numbers of coins in different sorts are preferentially paid out.

That is, in the present invention, the numbers of coins in different sorts to be paid out from the coin accumulators for accumulation of a plurality of coins according to the sorts of the coins are examined and coins of the sort corresponding to maximum one of the coin numbers in different sorts are preferentially paid out.

In accordance with another aspect of the present invention, there is provided a coin processor which comprises every-sort coin payment numbers determination means for determining the numbers of coins in different sorts corresponding to a payment amount, maximum-payment coin number detection means for detecting one of the sorts corresponding to maximum one of the numbers of coins in the different sorts determined by the every-sort coin payment numbers determination means, payment pattern setting means for setting a payment pattern of a coin sort priority corresponding to the maximum coin payment number detected by the maximum-payment coin number detection means, and coin payment means for paying out various sorts of coins according to the payment pattern set by the payment pattern setting means.

In the present invention, if the succeeding coin has arrived at the coin discrimination means before the preceding coin passed through the coin discrimination means arrives at the disposition position of the true/false coin distribution means, the control means causes the true/false coin distribution means to be shifted to the false coin side to distribute both of the preceding and succeeding coins to the false coin side.

In this case, the control means includes timer means for measuring a time slightly shorter than a time necessary for the preceding coin to reach the disposition position of the true/false coin distribution means and also includes forcible operation control means, if the succeeding coin has arrived at the coin discrimination means before the timer means times out, for forcibly shifting the true/false coin distribution means to the false coin side.

In the invention, further, when a preceding coin passed through the coin discrimination means is a true one and if a succeeding coin has arrived at the coin discrimination means immediately after the preceding coin has passed through the true/false coin distribution means, the control means causes the true/false coin distribution means to be shifted to its false coin side to distribute the succeeding coin to the false coin side.

In this case, the control means includes timer means for measuring a time slightly longer than a time necessary for the preceding coin to pass through the disposition position of the true/false coin distribution means and also includes forcible operation control means, if the succeeding coin has arrived at the coin discrimination means at the time the timer means timed out, for forcibly shifting the true/false coin distribution means to the false coin side.

In the invention, if a succeeding coin has arrived at the coin discrimination means before a preceding coin passed through the coin discrimination means arrives at a disposition position of the true/false coin distribution means, the control means causes the true/false coin distribution means to be shifted to its false coin side to distribute both of the preceding and succeeding coins to the false coin side, and, when the preceding coin passed through the coin discrimination means is a true one and if the succeeding coin has already arrived at the coin discrimination means immediately after the preceding coin has passed through the true/false coin distribution means, the control means causes the true/false coin distribution means to be shifted to its false coin side to distribute the succeeding coin to the false coin side.

In this case, the control means includes a first timer means for measuring a time slightly shorter than a time necessary for the preceding coin to arrive at the disposition position of the true/false coin distribution means, first forcible operation control means, if the succeeding coin has arrived at the coin discrimination means before the first timer means times out, for forcibly shifting the true/false coin distribution means to the false coin side, second timer means for measuring a time slightly longer than a time necessary for the preceding coin to pass through the disposition position of the true/false coin distribution means, and a second forcible operation control means, if the succeeding coin has already arrived at the coin discrimination means at the time the timer means timed out, for forcibly shifting the true/false coin distribution means to the false coin side.

In the invention, when a preceding coin passed through the coin discrimination means is a false one and if a succeeding coin has arrived at the coin discrimination means before the preceding coin passes through the true/false coin distribution means, the control means causes the true/false coin distribution means to be shifted to its false coin side to distribute the succeeding coin to the false coin side.

In this case, the control means includes a timer means for measuring a time slightly longer than a time necessary for the preceding coin to pass through the disposition position of the true/false coin distribution means and also includes forcible operation control means, if the succeeding coin has arrived at the coin discrimination means before the timer means times out, for forcibly shifting the true/false coin distribution means to the false coin side.

In the invention, the judgement means, when receiving the coin payment set command, judges the presence or absence of a coin within the coin discriminator/distributor, and the coin payment control means, when the judgement means judges the absence of the coin within the coin discriminator/distributor, immediately pays out coins corresponding to the coin payment amount sent from the main controller and, when the judgement means judges the presence of the coin within the coin discriminator/distributor, the coin payment control means pays out coins corresponding to the coin payment amount calculated by the main controller after the coin present within the coin discriminator/distributor has passed through the coin discriminator/distributor.

In this case, the coin payment control means, when the coin accumulator/payer is set in the coin payment state, transmits a coin payment enable notification to the main controller and, in response to the coin payment command received from the main controller when receiving the coin payment enable notification, starts the coin paying operation.

Further, the coin payment control means, when the judgement means judges the absence of a coin within the coin discriminator/distributor, immediately transmits the coin payment enable notification to the main controller.

Furthermore, the coin payment control means includes a first timer means for measuring a first time necessary for the coin within the coin discriminator/distributor to passe through the coin discriminator/distributor, and the coin payment control means, when the judgement means judges the presence of the coin within the coin discriminator/distributor, transmits the coin payment enable notification to the main controller after passage of the first time of the first timer means from the time of reception of the coin payment set command.

Also, the coin payment control means includes first timer means for measuring a first time necessary for the coin within the coin discriminator/distributor to pass through the coin discriminator/distributor and a second timer means for measuring a second time necessary for the coin passed through the coin discriminator/distributor to be completely accumulated in the coin accumulator of the coin accumulator/payer, and the coin payment control means, when judging the presence of a coin within the coin discriminator/distributor, transmits the coin payment enable notification to the main controller after the first time of the first timer means has timed out from the time of reception of the coin payment set command and, when the coin present in the coin accumulator has the same coin sort as present in the coin discriminator/distributor, the coin payment control means immediately starts coin paying operation and, when the coin present in the coin accumulator does not have the same coin sort as in the coin discriminator/distributor, the coin payment control means starts the coin paying operation in response to the coin payment command received from the main controller after passage of the first time of the first timer means and further after passage of the second time of the second timer means.

In addition, the coin payment control means includes a first timer means for measuring a first time necessary for the coin within the coin discriminator/distributor to pass through the coin discriminator/distributor and second timer means for measuring a second time necessary for the coin passed through the coin discriminator/distributor to be completely accumulated in coin accumulators of the coin accumulator/payer, and the coin payment control means, when judging the presence of a coin within the coin discriminator/distributor, transmits the coin payment enable notification to the main controller under conditions that the first time of the first timer means after reception of the coin payment set command expires and that the coin present in the coin accumulator has the same coin sort as in the coin discriminator/distributor and, when the coin present in the coin accumulator does not has the same coin sort as in the coin discriminator.distributor, the coin payment control means transmits the coin payment enable notification to the main controller after passage of the first time of the first timer means and further after passage of the second time of the second timer means.

In the invention, the numbers of coins in different sorts to be paid are examined and payment is carried out preferentially from coins of the type corresponding to maximum one of the numbers of coins in different sorts to be paid, whereby the time necessary for the coin payment is shortened.

In the invention, further, the numbers of coins having different sorts corresponding to the payment amount are determined by the every-sort coin payment numbers determination means, one of the sorts corresponding to maximum one of the determined numbers of coins in the different sorts is detected by the maximum-payment coin number detection means, a payment pattern of a coin sort priority corresponding to the detected maximum coin payment, and various sorts of coins according to the set payment pattern are paid out by the coin payment means.

DESCRIPTION OF THE PREFERRED EMBODIMENTS

An embodiment of the coin processor in accordance with the present invention will be detailed with reference to the accompanying drawings.

Figure 1:
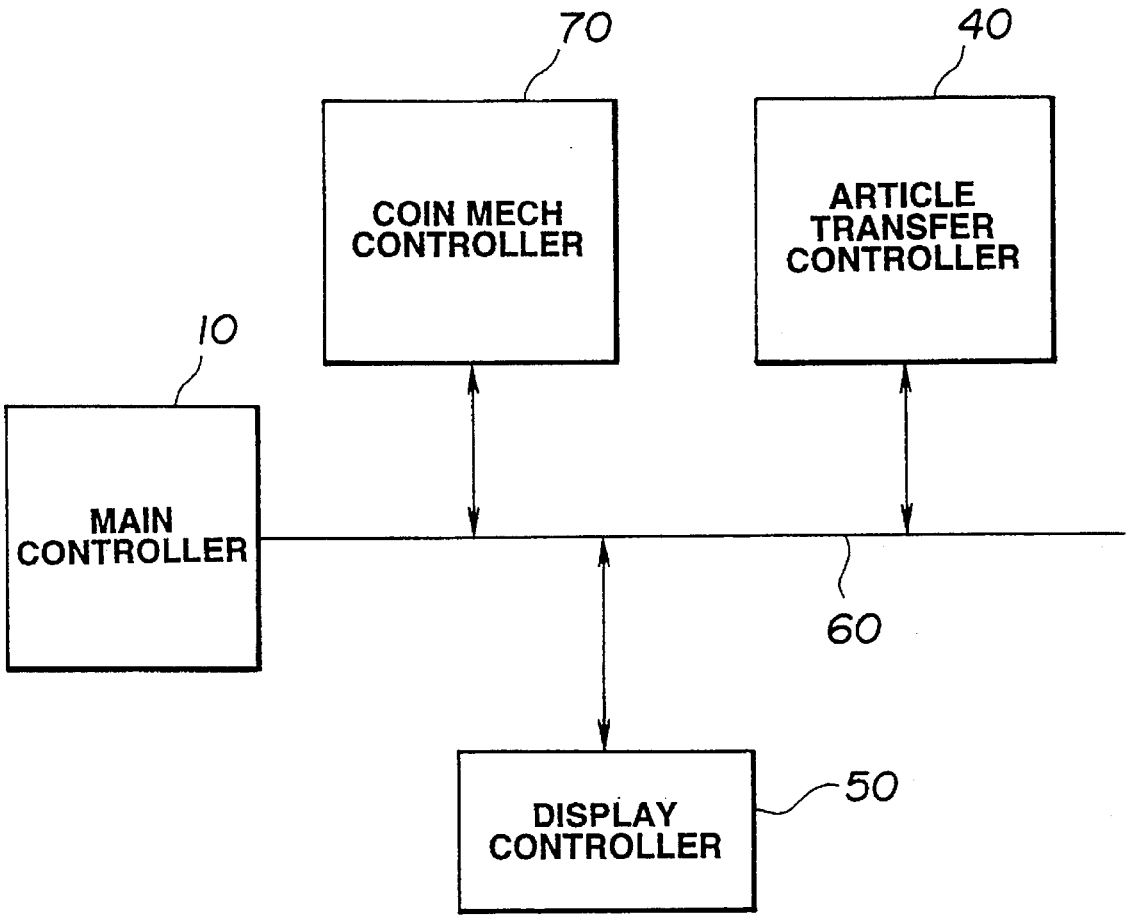
FIG. 1 is a block diagram of an embodiment of an automatic vending machine system to which a coin processor in accordance with the present invention is applied.
Figure 14:
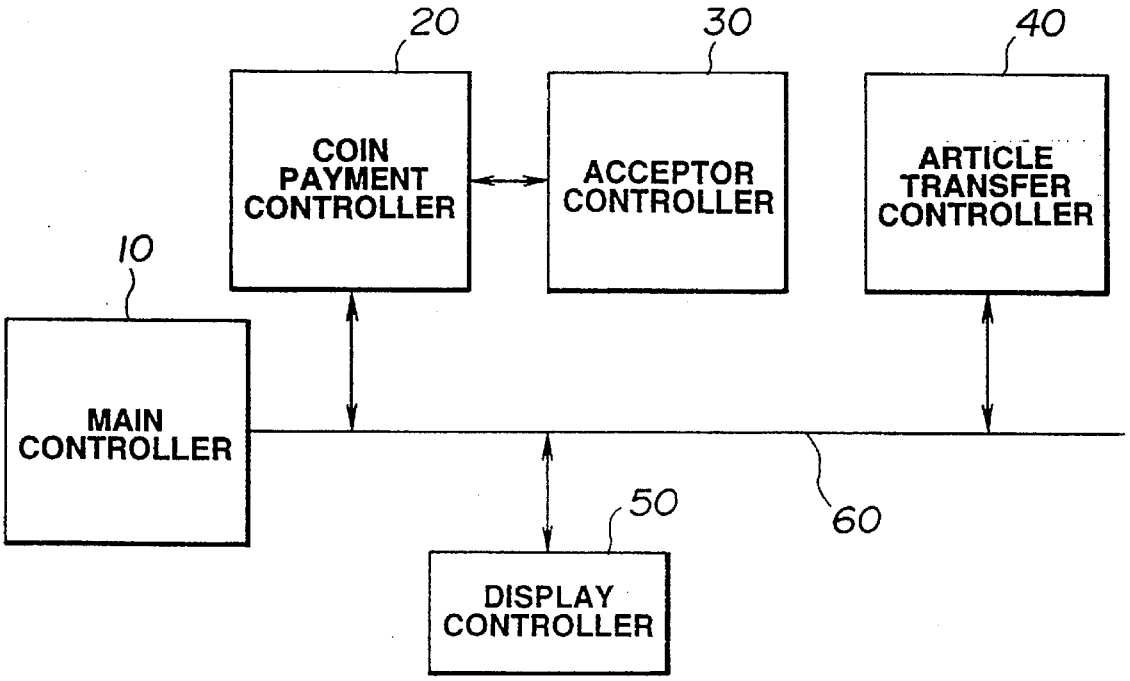
FIG.14 (PRIOR ART)
FIG. 14 is a block diagram of a prior art automatic vending machine system arranged as a function dispersion type system.

Referring first to FIG. 1, there is shown an embodiment of an automatic vending machine system employing a coin processor in accordance with the present invention, in which parts having the same functions as those in the prior art system of FIG. 14 are denoted by the same reference numerals as those in FIG. 14 for convenience of explanation. The automatic vending machine system of FIG. 1 is arranged as a function dispersion type system similarly to the system of FIG. 14. Thus, in the system of FIG. 1, a coin mech controller 70 is provided in place of a coin payment controller 20 and an acceptor controller 30 in FIG. 14.

More specifically, in the embodiment of the present invention, a single coin mech controller 70 is provided for an acceptor and a coin mech body, in place of the acceptor controller 30 and coin payment controller 20 provided in the respective acceptor and coin mech body in FIG. 14. In this way, in the present embodiment, the single coin mech controller 70 is provided for the acceptor and coin mech body, i.e., for the entire coin mech unit, and the coin mech controller 70 performs control over the acceptor, that is, control of discriminating between inserted coins and distributing them according to whether they are true and false coins, and also performs control over the coin mech body, that is, control of driving out coins from coin tubes.

With such an arrangement of the present embodiment, the coin mech controller 70 can know the presence or absence of coins within the acceptor and the start timing of the coin paying operation of the coin mech side in the presence of a coin within the acceptor is made different from that in the absence of a coin, which will be detailed later.

Figure 2:
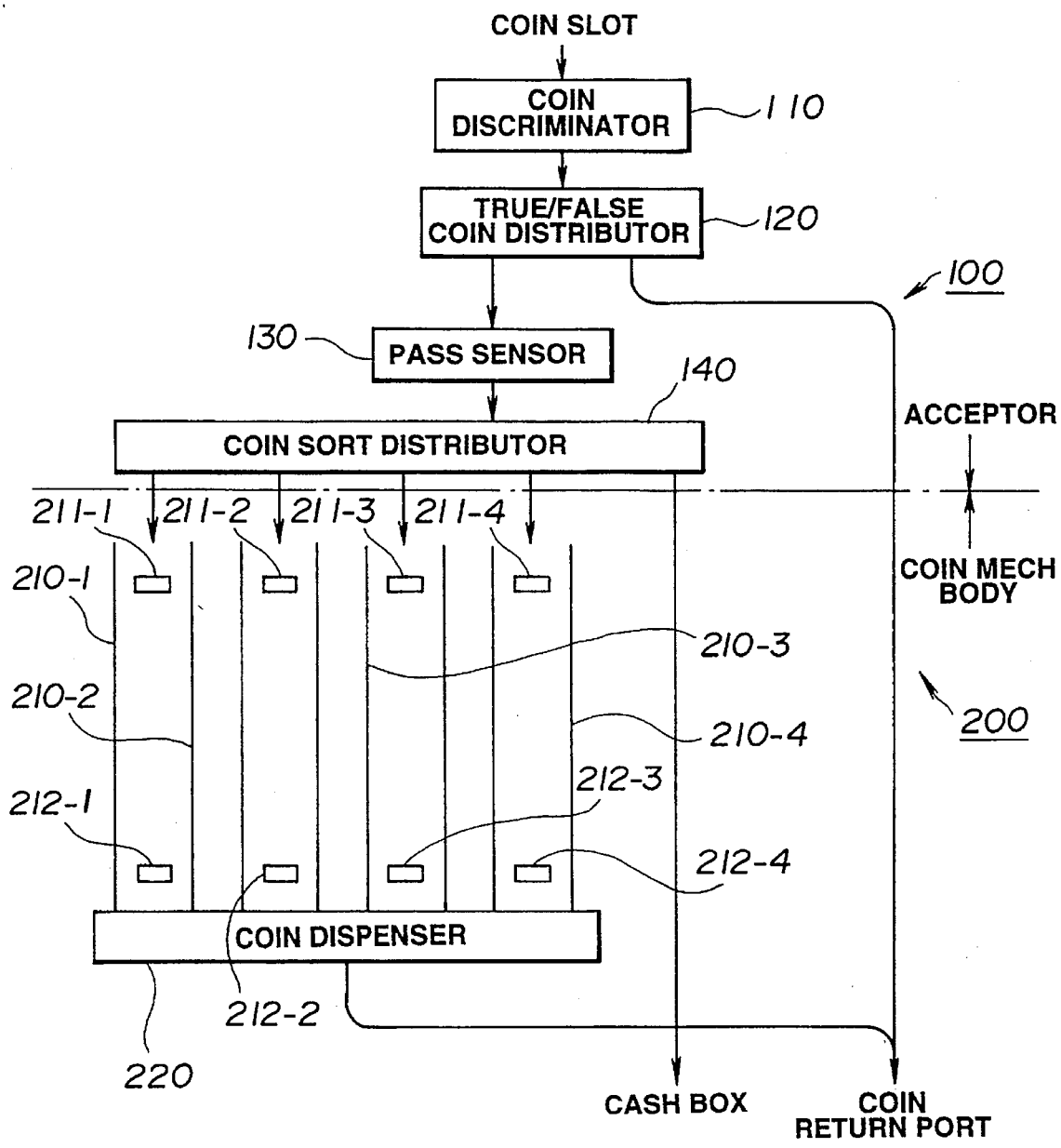
FIG. 2 is a detailed arrangement of a coin processor (coin mech unit) in accordance with the present invention.

FIG. 2 shows a detailed structure of the coin mech unit which is made up of an acceptor 100 and a coin mech body 200.

The acceptor 100 includes a coin discriminator 110 for determining whether or not coins inserted into a coin slot are genuine, a true/false coin distributor 120 for dividing the coins passed through the coin discriminator 110 into genuine and false groups on the basis of a determination result of the coin discriminator 110 and for guiding the genuine coins to a pass sensor 130 for detecting a pass of the true coin separated by the true/false coin distributor 120 and the false coins to a coin return port, and a coin sort distributor 140 for distributing the coins passed through the pass sensor 130 according to the coin sorts.

In the illustrated example, the coin discriminator 110 comprises, e.g., a known electronic coin discriminator made up of a plurality of coin detection coils for example, the true/false coin distributor 120 comprises a true/false coin distribution gate and a true/false coin distribution solenoid for driving the gate (both not shown), and the pass sensor 130 comprises, e.g., a magnetic proximity switch made up of a coil, etc.

The coin sort distributor 140 functions to distribute coins to be used as change according to coin sorts and also to distribute coins not used as change to a cash box.

Figure 3:
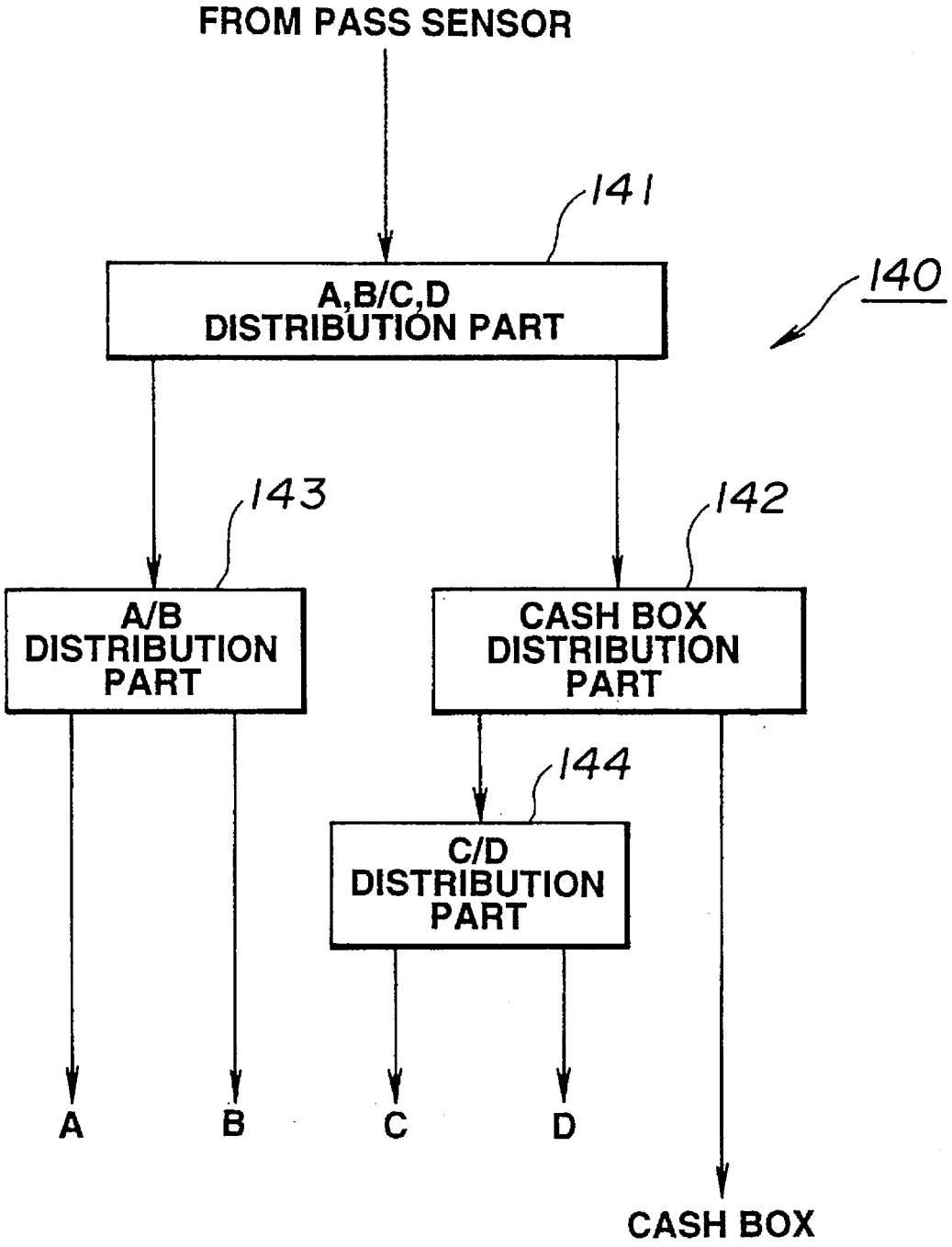
FIG. 3 shows a detailed arrangement of a money sort distributor of an acceptor shown in FIG. 2.

Shown in FIG. 3 is a detailed structure of the coin sort distributor 140. The present embodiment is arranged to use 4 sorts A, B, C and D of coins as coins to be used as change. The coin sort distributor 140 distributes the 4 sorts (A, B, C and D) of coins and guides coins not used as change to the cash box.

In FIG. 3, the coin sort distributor 140 includes an A-B/C-D distribution part 141 for dividing the coins received from the pass sensor 130 into a first group including the coins A and B and a second group including the coins C and D, a cash box distribution part 142 for determining whether or not the coins of the second group divided by the A-B/C-D distribution part 141 are guided to the cash box, an A/B distribution part 143 for dividing the coins of the first group divided by the A-B/C-D distribution part 141 into a coin A group and a coin B group, and a C/D distribution part 144 for dividing the coins not guided by the cash box distribution part 142 to the cash box into a coin C group and a coin D group.

In this connection, when there is another sort of coins which can be used in addition to the coins A, B, C and D to be used as change, the A-B/C-D distribution part 141 distributes this sort of coins to the second group. Further, when an overflow of any of coin tubes 210-1 to 210-4 of the coin mech body 200 is detected by any of overflow sensors 211-1 to 211-4, the A-B/C-D distribution part 141 distributes the overflowed coin also to the second group even if the overflowed coin is any of the coins A, B, C and D. The A-B/C-D distribution part 141 is made up of a first distribution gate and a first solenoid for driving the first distribution gate (both not shown).

Further, the cash box distribution part 142 functions to guide the coins of the second group divided by the A-B/C-D distribution part 141 to the cash box or to the C/D distribution part 144, and the A/B distribution part 143 divides the coins into the coin A group and coin B group. Since the grouping by the cash box distribution part 142 is not carried out simultaneously with the grouping by the A/B distribution part 143, however, the cash box distribution part 142 and A/B distribution part 143 include a second distribution gate for guiding the coins to the cash box or to the C/D distribution part 144, a third distribution gate for separating the coins into the coin A and B groups, and a second solenoid for driving the second and third distribution gates commonly. In this case, when the second solenoid is turned ON to drive the second distribution gate, for example, The third distribution gate is also driven without causing any disadvantageous effects.

The C/D distribution part 144 includes a fourth distribution gate and a third solenoid for driving the fourth distribution gate (both not shown).

Turning again to FIG. 2, the coin mech body 200 also includes a coin dispenser 220 for driving out coins from the 4 coin tubes 210-1 to 210-4 for storage of the respective coins A, B, C and D separated by the coin sort distributor 140 and for guiding the driven-out coins to the coin return port.

The coin tubes 210-1 to 210-4 are provided therein with empty sensors 212-1 to 212-4 for detecting a state (called "empty" in this embodiment) when the number of coins accumulated within the respective coin tubes 210-1 to 210-4 becomes smaller than a predetermined lower limit number and with the already-mentioned overflow sensors 211-1 to 211-4 for detecting a state (which is called "overflow" in this embodiment) when the number of coins accumulated within the coin tubes 210-1 to 210-4 becomes larger than a predetermined upper limit number, respectively.

The empty sensors 212-1 to 212-4 and overflow sensors 211-1 to 211-4 comprise, for example, optical sensors composed of light emitting and receiving elements disposed on the side walls of the respective coin tubes 210-1 to 210-4 at their predetermined positions so as to sandwich the coin tubes 210-1 to 210-4.

When either of the overflow sensors 211-1 to 211-4 detects the overflow of coins in either of the coin tubes 210-1 to 210-4, the A-B/C-D distribution part 141 shown in FIG. 3 acts to distribute ones of the coins which have passed through the pass sensor 130 and which correspond to the overflowed one of the coin tubes to the cash box distribution part 142, and the cash box distribution part 142 acts to distribute that coins to the cash box side.

With the aforementioned arrangement, the true/false coin distributor 120 distributes, on the basis of the judgement result of the coin discriminator 110, the genuine and false coins, and the coin sort distributor 140 separates the coins into the respective sorts according to the judgement result of the coin discriminator 110. The coin sort distributor 140 also counts the money amount of the inserted coins (genuine coins) on the basis of an output of the pass sensor 130 and the judgement result of the coin discriminator 110. However, when coins are continuously inserted through the coin slot, the system cannot perform accurately, in some cases, the genuine/false coin separating operation of the true/false coin distributor 120, the coin sort separating operation of the coin sort distributor 140, and the counting operation of the amount of the inserted coins based on the output of the pass sensor 130. For example, such an erroneous operation takes place in the following situations 1) to 3).

1) In a case where the succeeding coin has reached the coin discriminator 110 before the preceding coin passed through the coin discriminator 110 arrives at the disposition position of the true/false coin distributor 120.

In this case, with respect to two of the preceding and succeeding coins, it is impossible to carry out accurately the true/false separating operation of the true/false coin distributor 120, the coin sort separating operation of the coin sort distributor 140, and the calculating operation of the total amount of the inserted coins based on the output of the pass sensor 130.

2) In a case where the preceding coin passed through the coin discriminator 110 is genuine one and the succeeding coin has already reached the coin discriminator 110 immediately after the preceding coin has passed through the true/false coin distributor 120.

In this case, the preceding coin can be subjected accurately to the coin sort separating operation of the coin sort distributor 140 and to the counting operation of the amount of the inserted coins based on the output of the pass sensor 130, whereas, the succeeding coin cannot be subjected accurately to the true/false separating operation of the true/false coin distributor 120, to the coin sort separating operation of the coin sort distributor 140, and to the counting operation of the amount of the inserted coins based on the output of the pass sensor 130.

3) In a case where the preceding coin passed through the coin discriminator 110 is a false one and the succeeding coin has arrived at the coin discriminator 110 before the preceding coin fully passes through the true/false coin distributor 120.

In this case, it is impossible to carry out accurately the true/false separating operation of the true/false coin distributor 120.

To avoid these, in accordance with the present embodiment, the true/false coin distributor 120 is controlled to guide both of the preceding and succeeding coins to the return passage in the case 1), the true/false coin distributor 120 is controlled so that the preceding coin is guided to the true coin passage while the succeeding coins is guided to the return passage in the case 2), and the true/false coin distributor 120 is controlled so that the succeeding coin is guided to the return passage in the case 3).

Next, explanation will be made in detail by referring to a flowchart collectively shown in FIGS. 4 to 6 for explaining the operation of the present embodiment.

Figure 4:
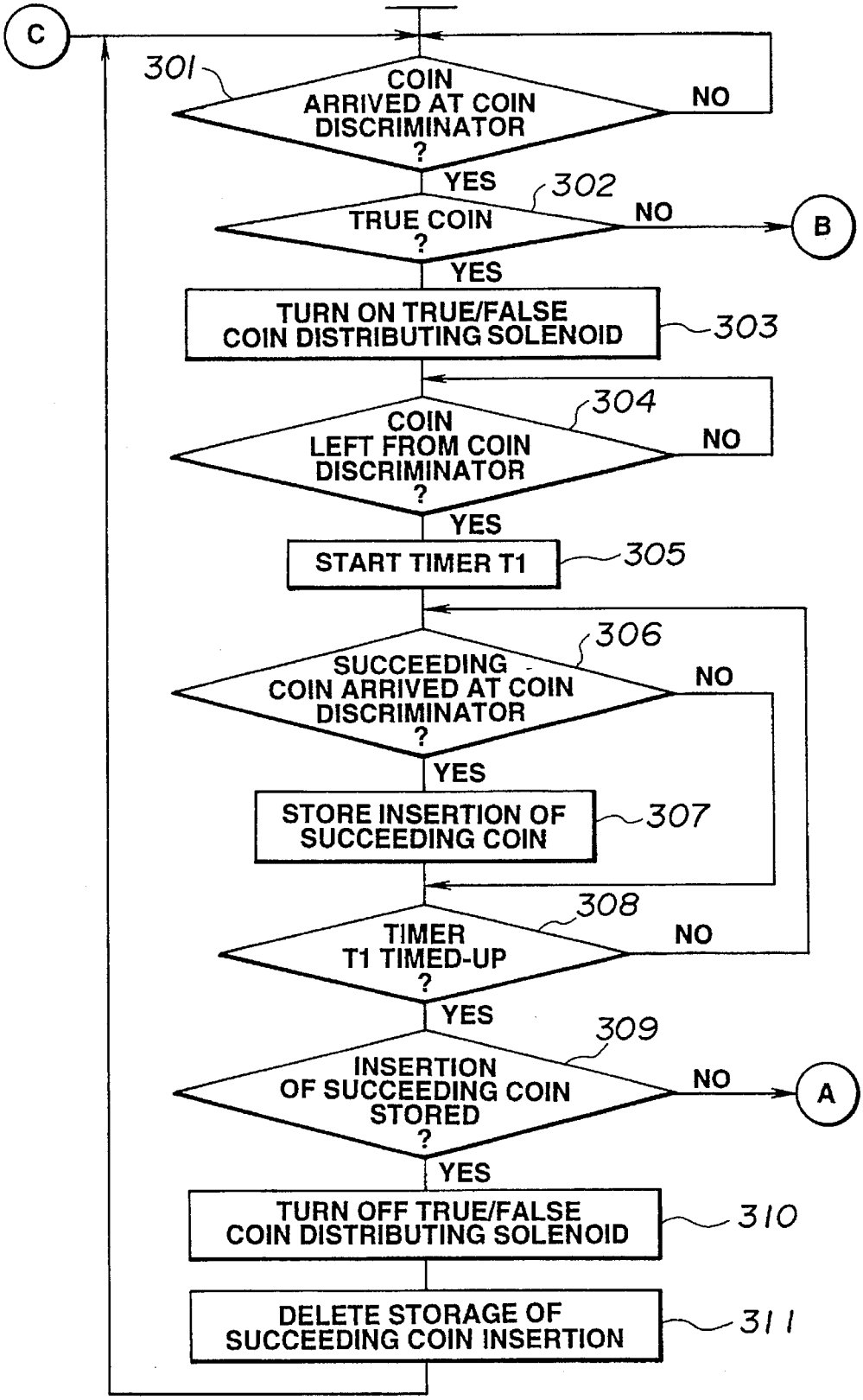
FIGS. 4 to 6 collectively show a flowchart for explaining the operation of the embodiment.

In FIG. 4, the coin mech controller 70, when detecting on the basis of the output of the coin discriminator 110 that a coin has arrived at the coin discriminator 110 (step 301), examines whether the coin is genuine or not on the basis of the output of the coin discriminator 110 (step 302). When determining that the coin is genuine one, the coin mech controller 70 turns 0N the true/false coin distribution solenoid (not shown) to cause the true/false coin distribution lever (not shown) of the true/false coin distributor 120 to be shifted to its true coin passage side, i.e., to the side of the pass sensor 130 (step 303).

And the coin mech controller 70 then examines, on the basis of the output of the coin discriminator 110, whether or not the coin has already passed through the coin discriminator 110, that is, whether or not the coin has fully passed through the coin discriminator 110 (step 304). When determining that the coin has passed through the coin discriminator 110, a first timer T1 is started at that timing (step 305). In this connection, the first timer T1 is set to be slightly shorter than a time taken after passage of the coin through the coin discriminator 110 and before arrival of the coin at the true/false coin distributor 120.

Next, on the basis of the output of the coin discriminator 110, the coin mech controller 70 examines whether or not the succeeding coin has arrived at the coin discriminator 110 (step 306). When determining that the succeeding coin has not arrived at the coin discriminator 110, the process goes to a step 308 to examine whether or not the first timer T1 has timed out. When determining that the first timer has not timed out, the process returns to the step 306 to again examine whether or not the succeeding coin has arrived at the coin discriminator 110.

When detecting in the step 306 the arrival of the succeeding coin at the coin discriminator 110, the coin mech controller 70 stores the insertion of the succeeding coin (step 307) and goes to the step 308.

When determining in the step 308 that the first timer T1 timed out, the coin mech controller 70 then examines whether the storage of the insertion of the succeeding coin has been stored (step 309). If the insertion of the succeeding coin has been stored, the coin mech controller 70 causes the true/false coin distribution solenoid to be turned OFF (step 310) and the storage of the insertion of the succeeding coin is deleted (step 311), after which the control goes again to the step 301.

In this case, since the true/false coin distribution solenoid is turned OFF before the preceding coin arrives at the disposition position of the true/false coin distributor 120, the true/false coin distribution lever (not shown) of the true/false coin distributor 120 is shifted to the return passage side so that the two of the preceding and succeeding coins are both returned to the return port through the return passage.

Figure 5:
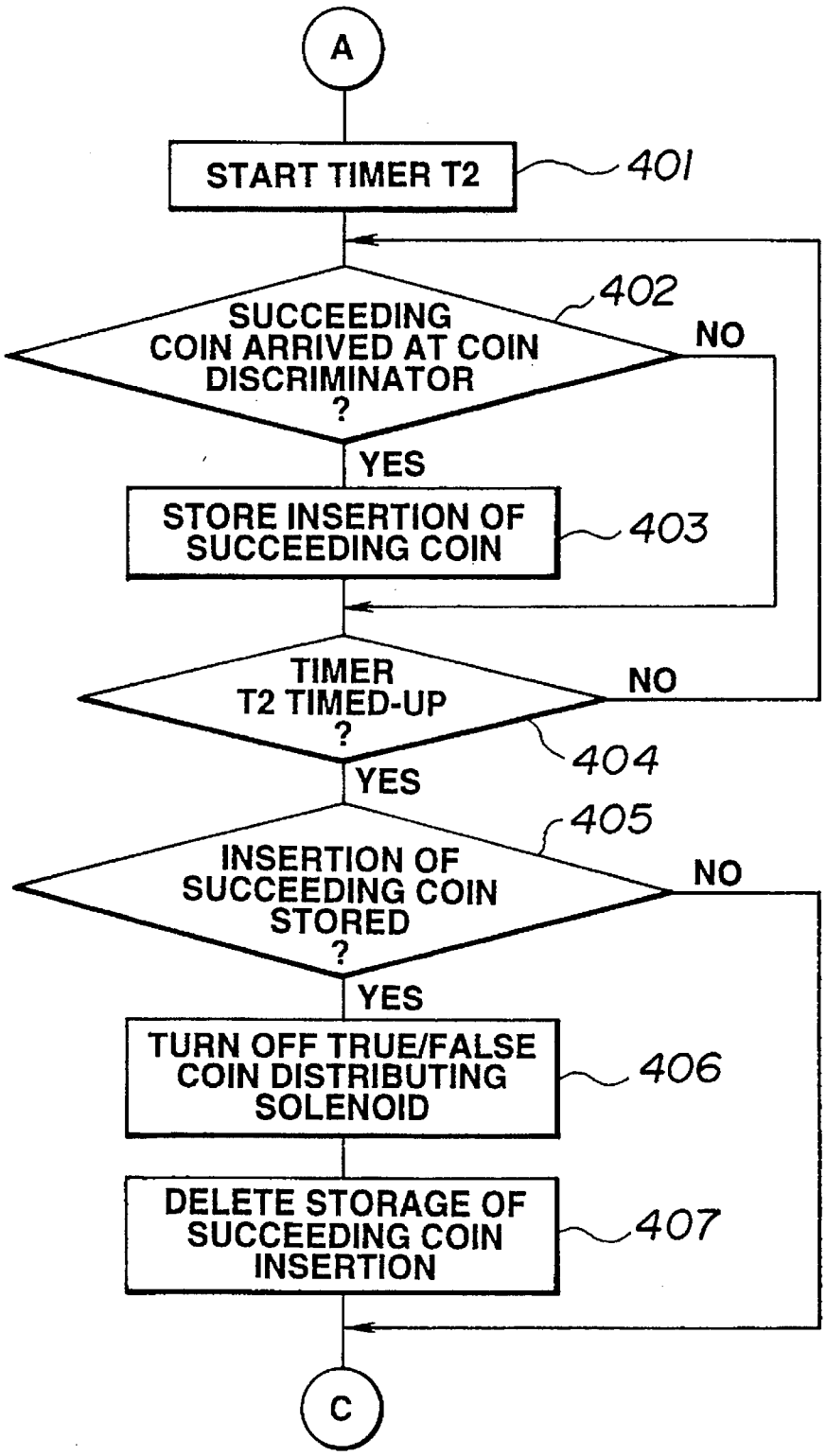

Determination of the absence of the storage of the insertion of the succeeding coin in the step 309 causes the control to proceed to such a flowchart as shown in FIG. 5.

In the flowchart of FIG. 5, a second timer T2 is first started (step 401). In this case, the second timer T2 is set to be slightly longer than a time taken for the coin passed through the coin discriminator 110 to fully pass through the true/false coin distributor 120.

After the second timer T2 is started, the coin mech controller 70 next examines whether or not the succeeding coin has arrived at the coin discriminator 110 (step 402). If the succeeding coin has not arrived yet at the coin discriminator 110, the control goes to a step 404 to examine whether or not the second timer T2 has timed out. When the second timer T2 has not timed out yet, the control returns to the step 402 to again examine whether or not the succeeding coin has arrived at the coin discriminator 110.

When detecting in the step 402 the arrival of the succeeding coin at the coin discriminator 110, the coin mech controller 70 stores the insertion of the succeeding coin (step 403) and goes to the step 404.

When determining in the step 404 that the second timer T2 has timed up, the coin mech controller 70 next examines whether or not the insertion of the succeeding coin has been stored (step 405). If the insertion of the succeeding coin has been stored, the coin mech controller 70 turns Off the true/false coin distribution solenoid (step 406) to delete the storage of the insertion of the succeeding coin (step 407) and returns to the step 301 in FIG. 4.

In this case, after the preceding coin has passed through the true/false coin distributor 120, the true/false coin distribution solenoid is turned OFF, which results in that the preceding coin is guided to the true coin passage but the succeeding coin is returned to the return port through the return passage.

When determining in the step 405 the absence of the storage of the insertion of the succeeding coin, the process returns to the step 301 in FIG. 4.

Figure 6:
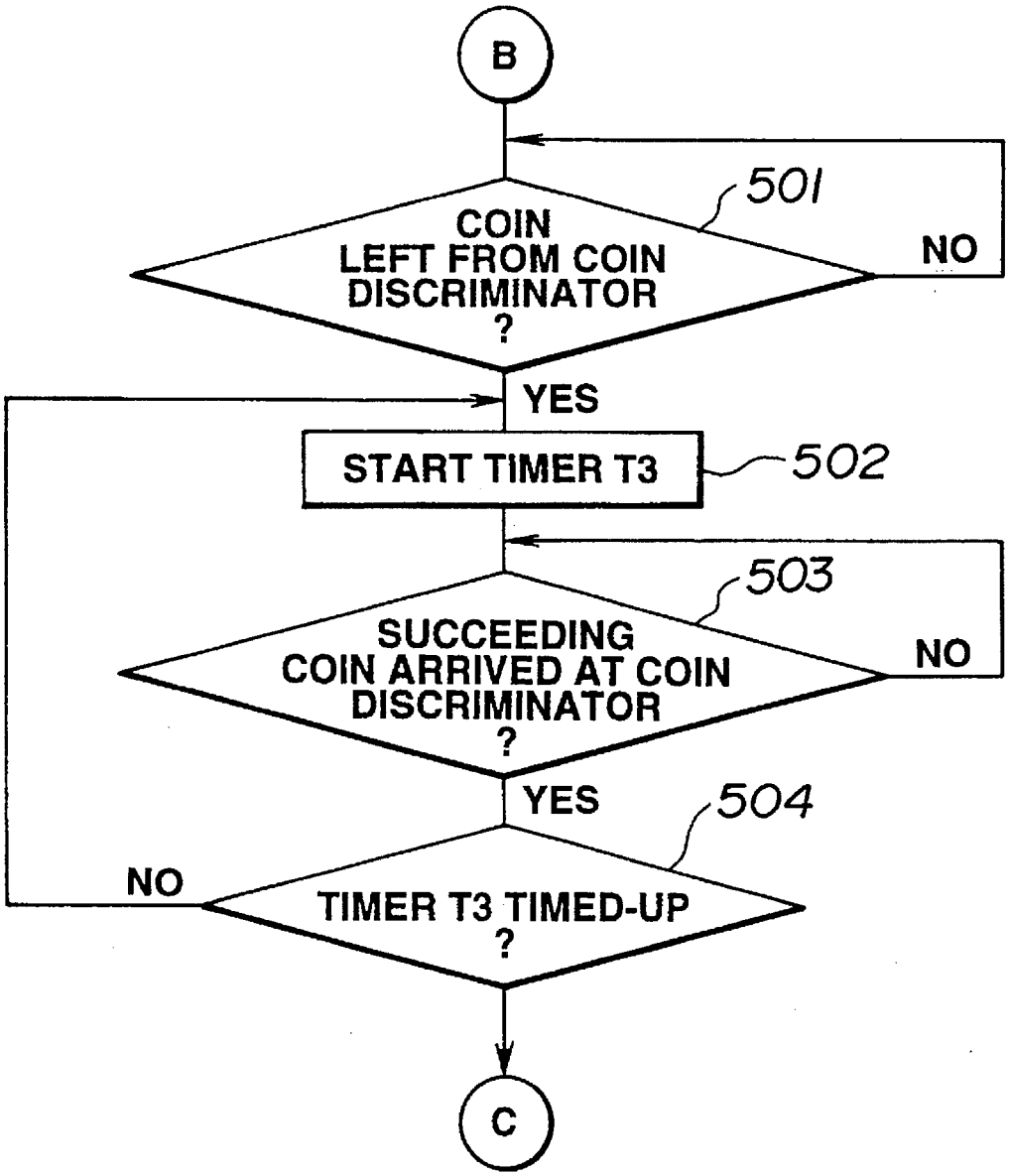

When judging in the step 302 of FIG. 4 that the inserted coin is not genuine one, i.e., a false one, the control moves to the process as shown in a flowchart of FIG. 6.

In the flowchart of FIG. 6, the coin mech controller 70 first examines whether or not the coin has passed through the coin discriminator 110, i.e., the coin has fully passed through the coin discriminator 110 (step 50). When the coin has passed through the coin discriminator 110, the coin mech controller 70 causes a third timer T3 to be started at that timing (step 50). In this example, the third timer T3 is set to be slightly longer than a time taken after the exit of the coin from the coin discriminator 110 before the exit of the coin from the true/false coin distributor 120.

Subsequently, on the basis of the output of the coin discriminator 110, the coin mech controller 70 examines whether or not the succeeding coin has arrived at the coin discriminator 110 (step 50). If the succeeding coin has arrived at the coin discriminator 110, the coin mech controller 70 next examines whether or not the third timer T3 has timed out (step 50). If the third timer T3 has not timed out, the control returns to the step 50 to again start the timer T3.

Determination of the step 50 that the third timer T3 has timed out causes the control to return to the step 301 of FIG. 4.

In this case, the true/false coin distribution solenoid of the true/false coin distributor 120 remains its OFF state and thus the succeeding coin is sent to the return port through the return passage regardless whether it is true or false one.

Figure 7:
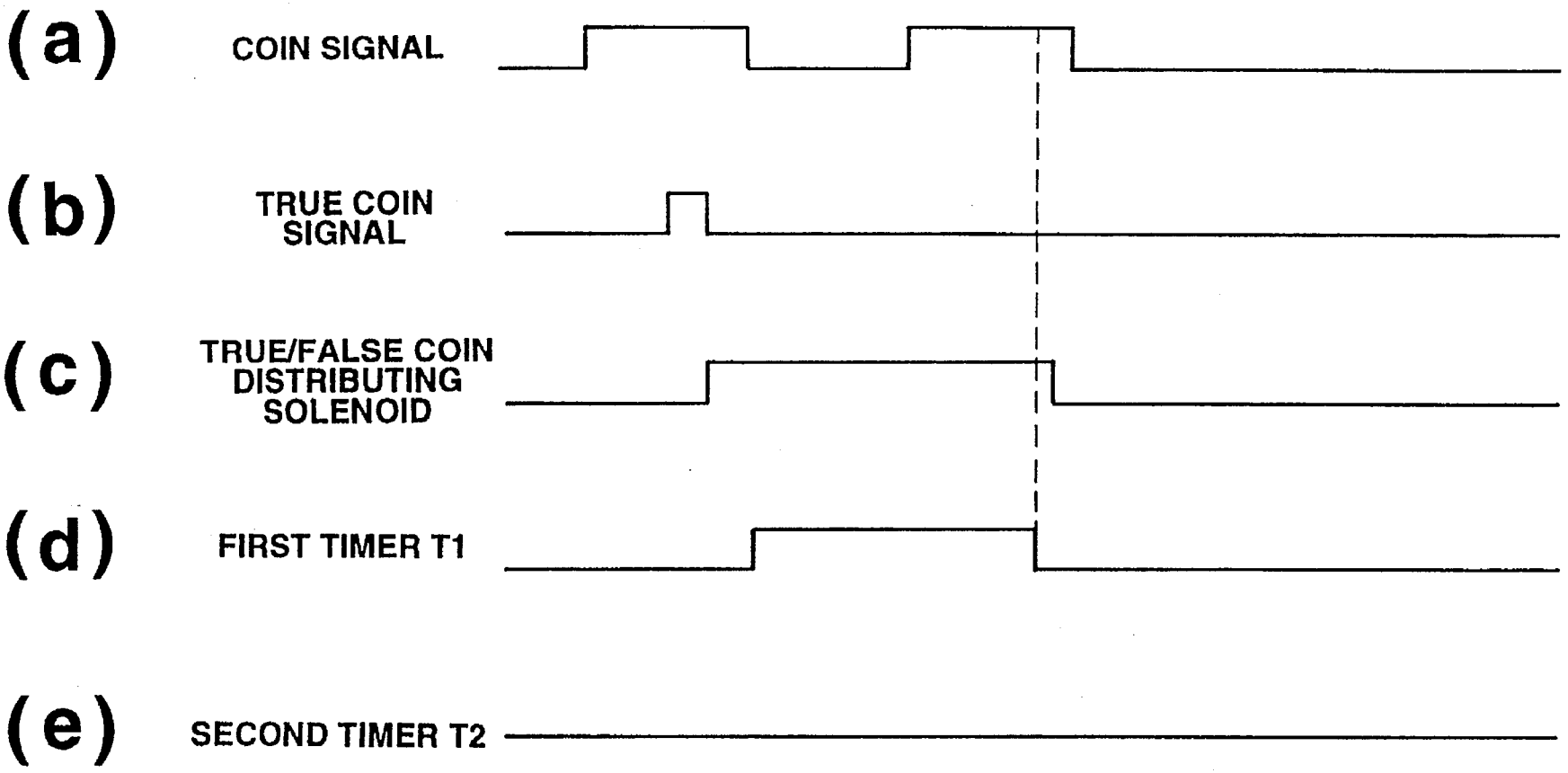
FIG. 7 is a timing chart for explaining the operation of the embodiment of a case where a succeeding coin arrives at a coin discriminator before a preceding coin passed through the coin discriminator reaches a disposition position of a true/false coin distributor.

Shown in FIG. 7 is a timing chart for explaining the operation of the embodiment when the succeeding coin arrives at the coin discriminator 110 before the preceding coin passed through the coin discriminator 110 arrives at the disposition position of the true/false coin distributor 120. When the preceding coin reaches the coin discriminator 110 (refer to a part (a) of FIG. 7) and the coin discriminator 110 outputs a true coin signal (refer to a part (b) of FIG. 7), this causes the true/false coin distribution solenoid of the true/false coin distributor 120 to be turned ON (refer to a part (c) of FIG. 7). The first timer T1 is started at the timing when the coin leaves the coin discriminator 110 (refer to a part (d) of FIG. 7). When the first timer T1 times out, if the succeeding coin arrives at the coin discriminator 110 (refer to the part (a) of FIG. 7), this causes the true/false coin distribution solenoid of the true/false coin distributor 120 to be turned OFF (refer to the part (c) of FIG. 7). In this case, the preceding and succeeding coins are both returned to the return port through the return passage and the second timer T2 is not operated (refer to the part (e) of FIG. 7).

Figure 8:
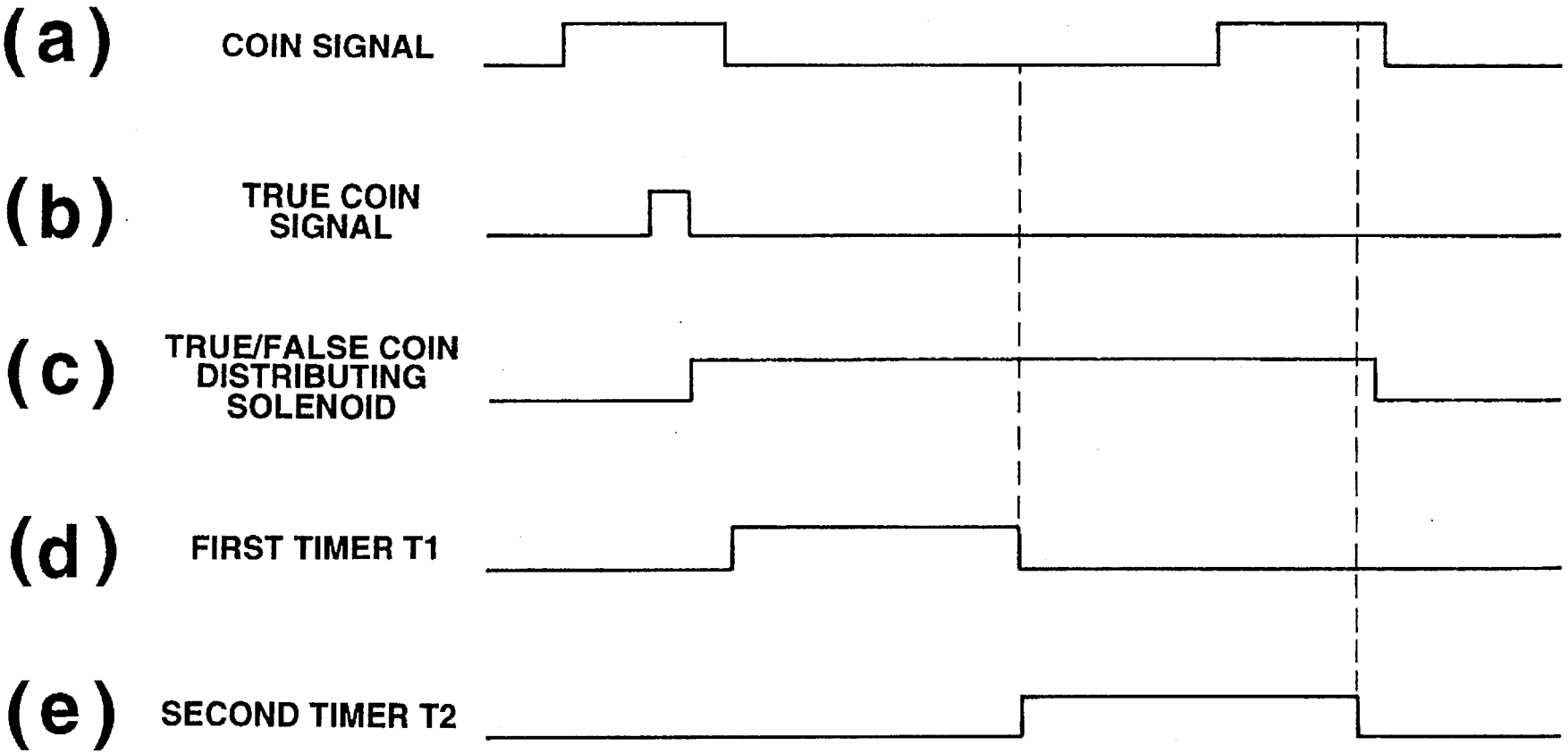
FIG. 8 is a timing chart for explaining the operation of the embodiment of a case where the preceding coin passed through the coin discriminator is a genuine one and where the succeeding coin has already reached the coin discriminator immediately after the preceding coin already passed through the true/false coin distributor.

FIG. 8 is a timing chart for explaining the operation of the embodiment when the preceding coin passed through the coin discriminator 110 is a genuine one and the succeeding coin has arrived at the coin discriminator 110 immediately after the preceding coin has passed through the true/false coin distributor 120. When the preceding coin reaches the coin discriminator 110 (refer to a part (a) of FIG. 8) and the coin discriminator 110 issues a true coin signal (refer to a part (b) of FIG. 8), this causes the true/false coin distribution solenoid of the true/false coin distributor 120 to be turned ON (refer to a part (c) of FIG. 8). The first timer T1 is started at the timing when the coin leaves the coin discriminator 110 (refer to a part (d) of FIG. 8). However, even when the first timer T1 times out, if the succeeding coin fails to arrive at the coin discriminator 110 (refer to the part (a) of FIG. 8), the second timer T2 is started (refer to a part (e) of FIG. 8). And when the succeeding coin arrives at the coin discriminator 110 (refer to the part (a) of FIG. 8) at the time of the time out of the second timer T2, this causes the true/false coin distribution solenoid of the true/false coin distributor 120 to be turned OFF (refer to the part (c) of FIG. 8). In this case, the preceding coin is guided to the true coin passage while the succeeding coin is returned to the return port through the return passage.

Figure 9:
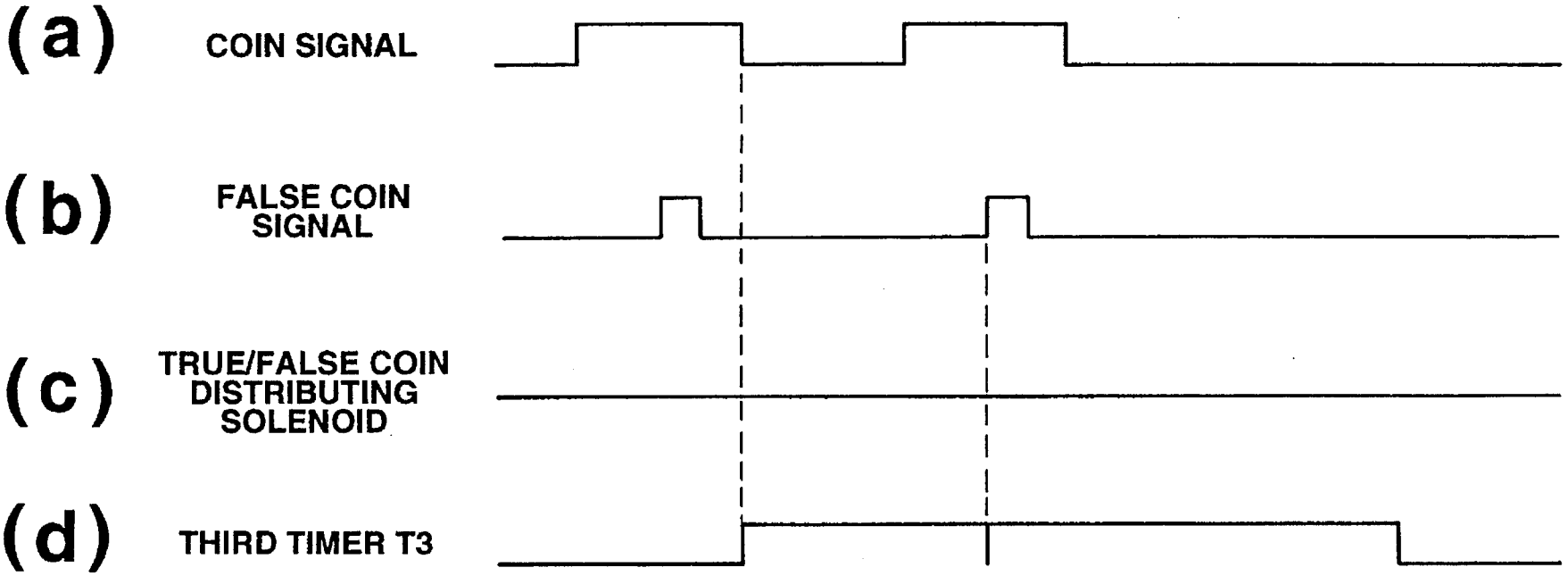
FIG. 9 is a timing chart for explaining the operation of the embodiment of a case where the preceding coin passed through the coin discriminator is a false one and where the succeeding coin reaches the coin discriminator before the preceding coin passes through the true/false coin distributor.

FIG. 9 is a timing chart for explaining the operation of the embodiment when the preceding coin passed through the coin discriminator 110 is a false one and the succeeding coin arrives at the coin discriminator 110 before the preceding coin passes through the true/false coin distributor 120. When the preceding coin reaches the coin discriminator 110 (refer to a part (a) of FIG. 9) and the coin is a false one, this causes the coin discriminator 110 to output a false coin signal (refer to a part (b) of FIG. 9). In this case, the true/false coin distribution solenoid of the true/false coin distributor 120 remains its OFF state (refer to a part (c) of FIG. 9). The third timer T3 is started at the timing when the coin leaves the coin discriminator 110 (refer to a part (d) of FIG. 9). When the succeeding coin arrives at the coin discriminator 110 before the third timer T3 times out (refer to the part (a) of FIG. 9), the third timer T3 is re-started so that, even when the succeeding coin is a true one, the true/false coin distribution solenoid of the true/false coin distributor 120 will not be turned ON (refer to the part (c) of FIG. 9). In this case, regardless of the fact that the succeeding coin is a true or false one, the coin is regarded as false one so that the coin is returned to the return port through the return passage.

Although the second timer T2 has been arranged to be started after the first timer T1 times out in the foregoing embodiment, the second timer T2 may be set to be slightly longer than the time taken after the coin has left the coin discriminator 110 until the coin leaves the true/false coin distributor 120 and the second timer T2 may be arranged to be started simultaneously with the first timer T1.

As has been explained in the foregoing, the present embodiment advantageously can eliminate erroneous operation when coins are continuously inserted and can remove the earlier-mentioned disadvantages, since the embodiment is arranged as mentioned in the following examples 1) to 3).

1) In a case where the succeeding coin has arrived at the coin discrimination means before the preceding coin passed through the coin discrimination means arrives at the disposition position of the true/false coin distribution means, the true/false coin distribution means is shifted to the false coin side to distribute both of the preceding and succeeding coins to the false coin side.

2) In a case where the preceding coin passed through the coin discrimination means is a true one and the succeeding coin has reached the coin discrimination means immediately after the preceding coin has passed through the true/false coin distribution means, the true/false coin distribution means is shifted to the false coin side to distribute only the succeeding coin to the false coin side.

3) In a case where the preceding coin passed through 00 the coin discrimination means is a false one and the succeeding coin has arrived at the coin discrimination means before the preceding coin passes through the true/false coin distribution means, the true/false coin distribution means is shifted to the false coin side to distribute the succeeding coin to the false coin side.

In accordance with the present invention, for the purpose of making the time necessary for change payment as short as possible, when the coin mech controller 70 receives from the main controller 10 the payment set command to set the coin mech unit in the coin payment enable state, the coin mech controller 70 examines whether or not a coin is present within the acceptor 100. In the absence of any coin within the acceptor 100, the coin mech controller 70 immediately transmits the payment enable notification to the main controller 10. When receiving the payment command from the main controller 10, the coin mech controller 70 is put in its change paying operation. In the presence of a coin within the acceptor 100, after the coin has passed through the acceptor 100, the coin mech controller 70 transmits the payment enable notification to the main controller 10. After receiving the payment command from the main controller 10, the coin mech controller 70 is put in the change paying operation state.

Figure 10:
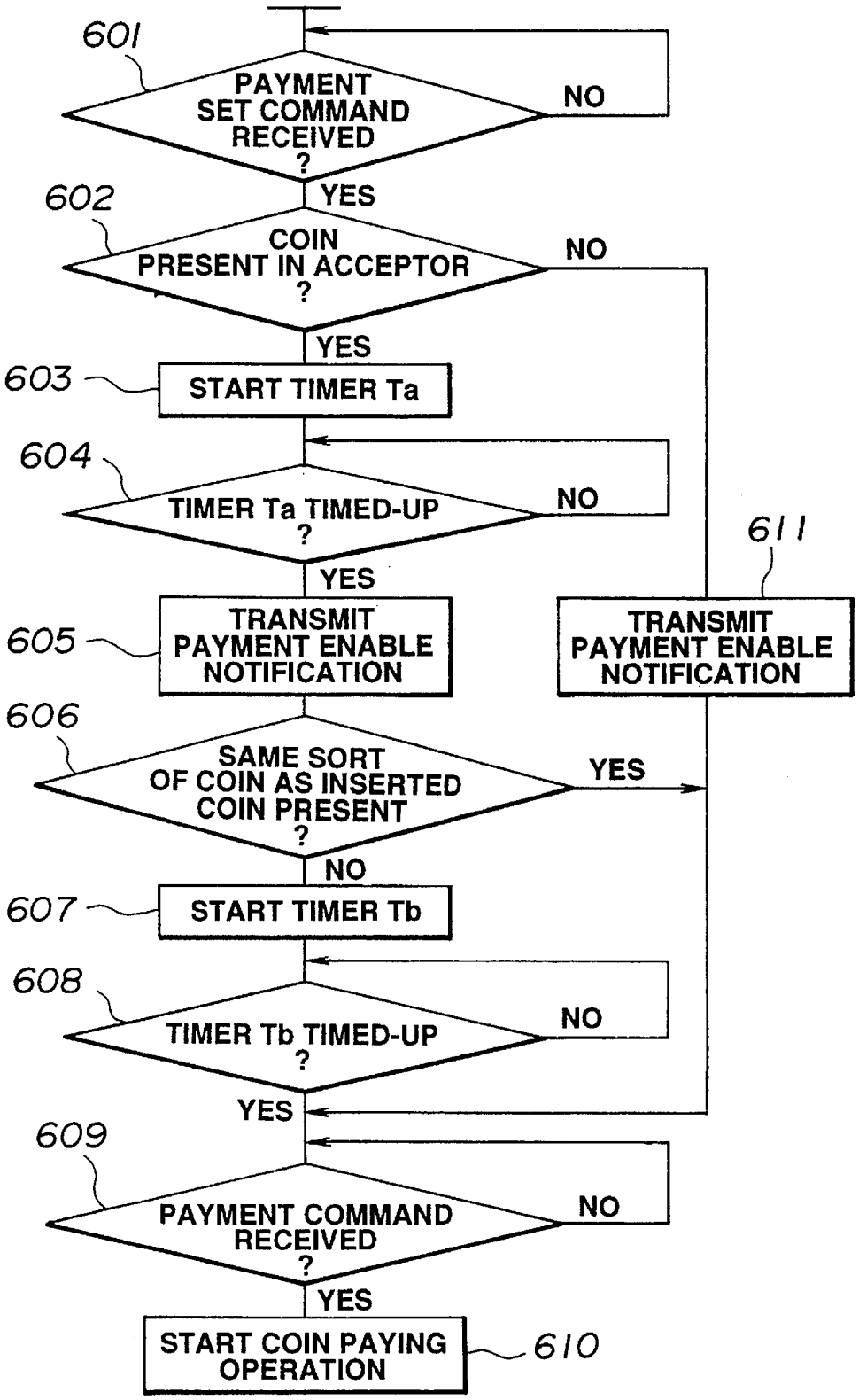
FIG. 10 is a flowchart for explaining the change paying operation in a coin mech controller shown in FIG. 2.

Explanation will next be made as to the change paying operation of the coin mech controller 70 by referring to a flowchart of FIG. 10.

The coin mech controller 70 first examines whether to have received the payment set command from the main controller 10 (step 601). When detecting the reception of the payment set command from the main controller 10, the coin mech controller 70 examines the presence or absence of a coin within the acceptor 100 (step 602). The coin presence or absence within the acceptor 100 can be detected on the basis of outputs of the coin discriminator 110 and pass sensor 130 in the acceptor 100. For example, when the coin discriminator 110 of the acceptor 100 generates the output while the pass sensor 130 fails to generate the output, the coin mech controller 70 judges the presence of a coin within the acceptor 100.

When judging in the step 602 the absence of coin within the acceptor 100, the coin mech controller 70 can move immediately to the change paying operation without causing any trouble. Thus, the coin mech controller 70 transmits the payment enable notification to the main controller 10 (step 611) and goes to a step 609. When receiving the payment command from the main controller 10 (step 609), the coin mech controller 70 starts its coin paying operation (step 610).

Determination of the presence of a coin within the acceptor 100 in the step 602 causes the coin mech controller 70 to detect a time point at which the coin has passed through the pass sensor 130 and to start a timer Ta (step 603). In this connection, the timer time of the timer Ta is set to correspond to a time necessary for the coin to leave the acceptor 100.

Next, the coin mech controller 70 examines whether or not the timer Ta has timed out (step 604). When the timer Ta has timed out, the coin mech controller 70 transmits the payment enable notification to the main controller 10 (step 605).

And the coin mech controller 70 examines whether or not the coin of the same sort as the coin present in the acceptor 100 is present in any of the coin tubes 210-1 to 210-4 (step 606). This processing can be carried out by examining an output of one of the empty sensors 212-1 to 212-4 of one of the coin tubes 210-1 to 210-4 corresponding to the same coin sort as the coin present within the acceptor 100.

When judging that the coin having the same sort as in the coin acceptor 100 is present in the coin tubes 210-1 to 210-4, the control proceeds to the step 609. The reception of the payment command from the main controller 10 (step 609) causes the coin mech controller 70 to start its coin paying operation (step 610).

However, when judging in the step 606 that the coin having the same coin sort as in the acceptor 100 is not present in the coin tubes 210-1 to 210-4, the coin mech controller 70 starts a timer Tb (step 607). In this connection, the timer time of the timer Tb is set to correspond to a time taken after the coin has left the acceptor 100 until the coin falls onto the bottom of the coin tubes 210-1 to 210-4.

The coin mech controller 70 examines whether or not the timer Tb has timed out (step 608). When the timer Tb has timed out, the control goes to the step 609. When receiving the payment command from the main controller 10 (step 609), the coin mech controller 70 starts its coin paying operation (step 610).

That is, if the coin having the same coin sort as in the coin acceptor 100 is not present in the coin tubes 210-1 to 210-4, the start of the change paying operation may cause lacking of change or coin clogging (even the coin after leaving the acceptor 100 and falling down to the bottom of the coin tubes 210-1 to 210-4 may in some cases be used as change). In such a case, the coin mech controller 70 waits for a time period corresponding to the time taken after the coin has left the acceptor 100 until the coin fully falls onto the bottom of the coin tubes 210-1 to 210-4 (that is, the timer time of the timer Tb), examines whether the payment command from the main controller 10 has been received, and thereafter starts the coin paying operation.

Figure 11:
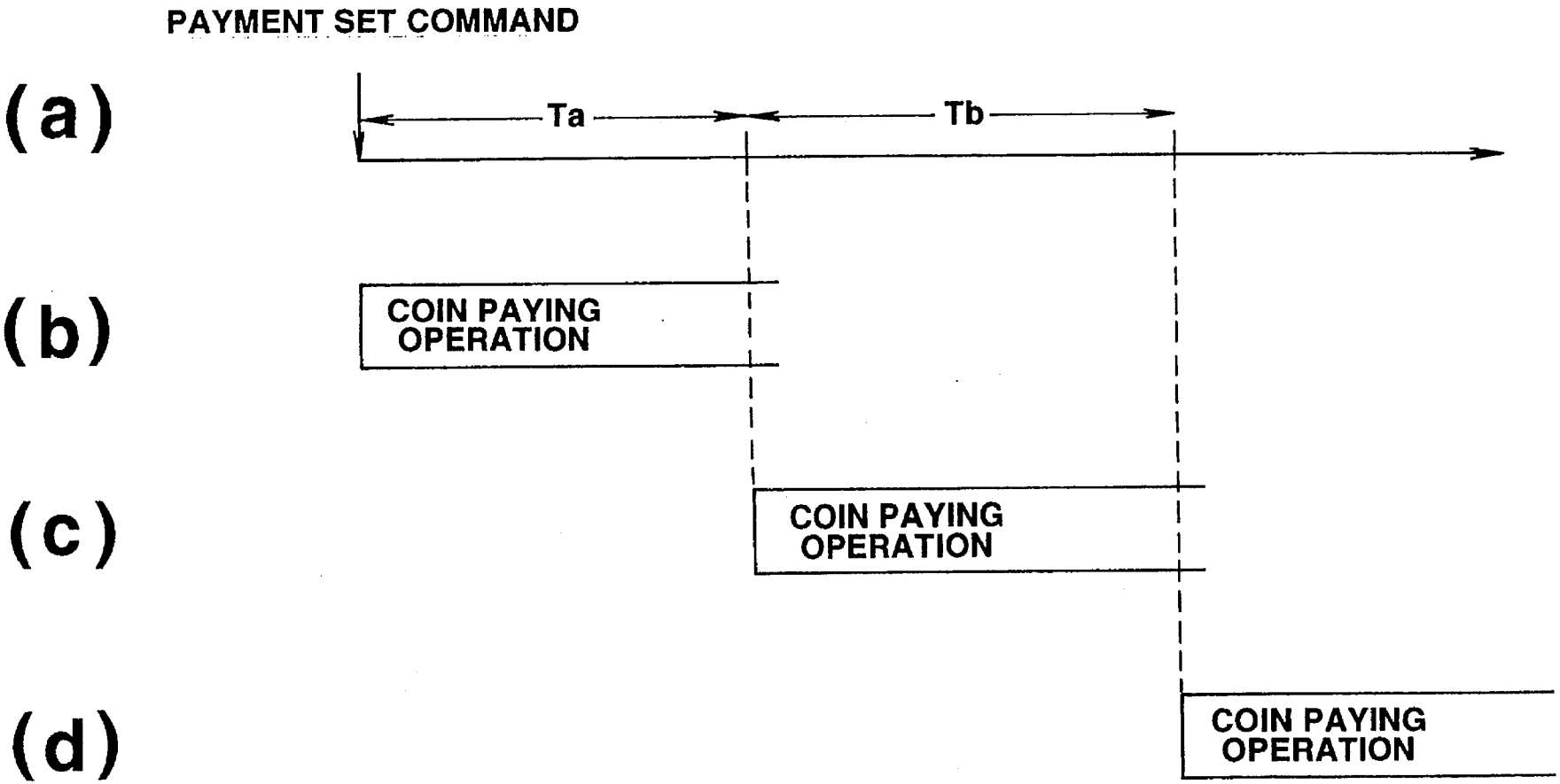
FIG. 11 is a timing chart for explaining a relationship of start timing of the coin paying operation of the embodiment of FIG. 2 with respect to the operational times of timers Ta and Tb.

FIG. 11 shows a timing chart showing a relationship of the start timing of the coin paying operation with respect to the operational times of the timers Ta and Tb in the present embodiment. More specifically, a part (a) of FIG. 11 shows the operational times of the timers Ta and Tb, a part (b) of FIG. 11 shows the start timing of the coin paying operation in the absence of any coin within the acceptor 100 when the coin mech controller 70 receives the payment set command from the main controller 10, a part (c) of FIG. 11 shows the start timing of the coin paying operation in the presence of a coin within the acceptor 100 and a coin having the same coin sort as the coin in the coin acceptor 100 is present in any of the coin tubes 210-1 to 210-4 when the coin mech controller 70 receives the payment set command from the main controller 10, and a part (d) of FIG. 11 shows the start timing of the coin paying operation in the presence of a coin within the acceptor 100 but a coin having the same coin sort as the coin in the coin acceptor 100 is not present in any of the coin tubes 210-1 to 210-4 when the coin mech controller 70 receives the payment set command from the main controller 10.

In FIG. 11, the case of the part (c) of FIG. 11 is rare and the case of the part (d) of FIG. 11 is more rare. Thus, the start timing of the coin paying operation can be made, in most cases, faster than that of the prior art arrangement, which results in that the time necessary for the change payment can be made as short as possible.

In the foregoing embodiment, when there is a coin within the acceptor 100 at the time point that the coin mech controller 70 receives the payment set command from the main controller 10, this causes the timer Ta to be started so that, when the timer Ta times out, the coin mech controller 70 transmits the payment enable notification to the main controller 10. At this time point, if the coin having the same coin sort as the coin in the coin acceptor 100 is not present in any of the coin tubes 210-1 to 210-4, then the embodiment is arranged so that the timer Tb is started and the coin mech controller 70 starts its coin paying operation only after the timer Tb times out. However, the present invention may be arranged so that, when the coin mech controller 70 receives the payment set command from the main controller 10, the coin mech controller 70 immediately transmits the payment enable notification to the main controller 10, in such a manner that, when there is no change in any of the coin tubes 210-1 to 210-4, the coin mech controller 70 waits until the coin passed through the acceptor 100 completely falls onto the bottom surface of the coin tubes 210-1 to 210-4, at which point the coin mech controller 70 starts its coin paying operation. With such an arrangement, the control can be realized with use of only a single timer and the timing of transmitting the payment enable notification to the main controller 10 can be made faster, thus enabling the main controller 10 to perform its earlier judging operation.

Although the coin mech controller 70 transmits the payment enable notification to the main controller 10 when the timer Ta times out in the foregoing embodiment, the present invention may be arranged so that the coin mech controller 70 transmits the payment enable notification to the main controller 10 when the timer Tb times out.

Figure 12:
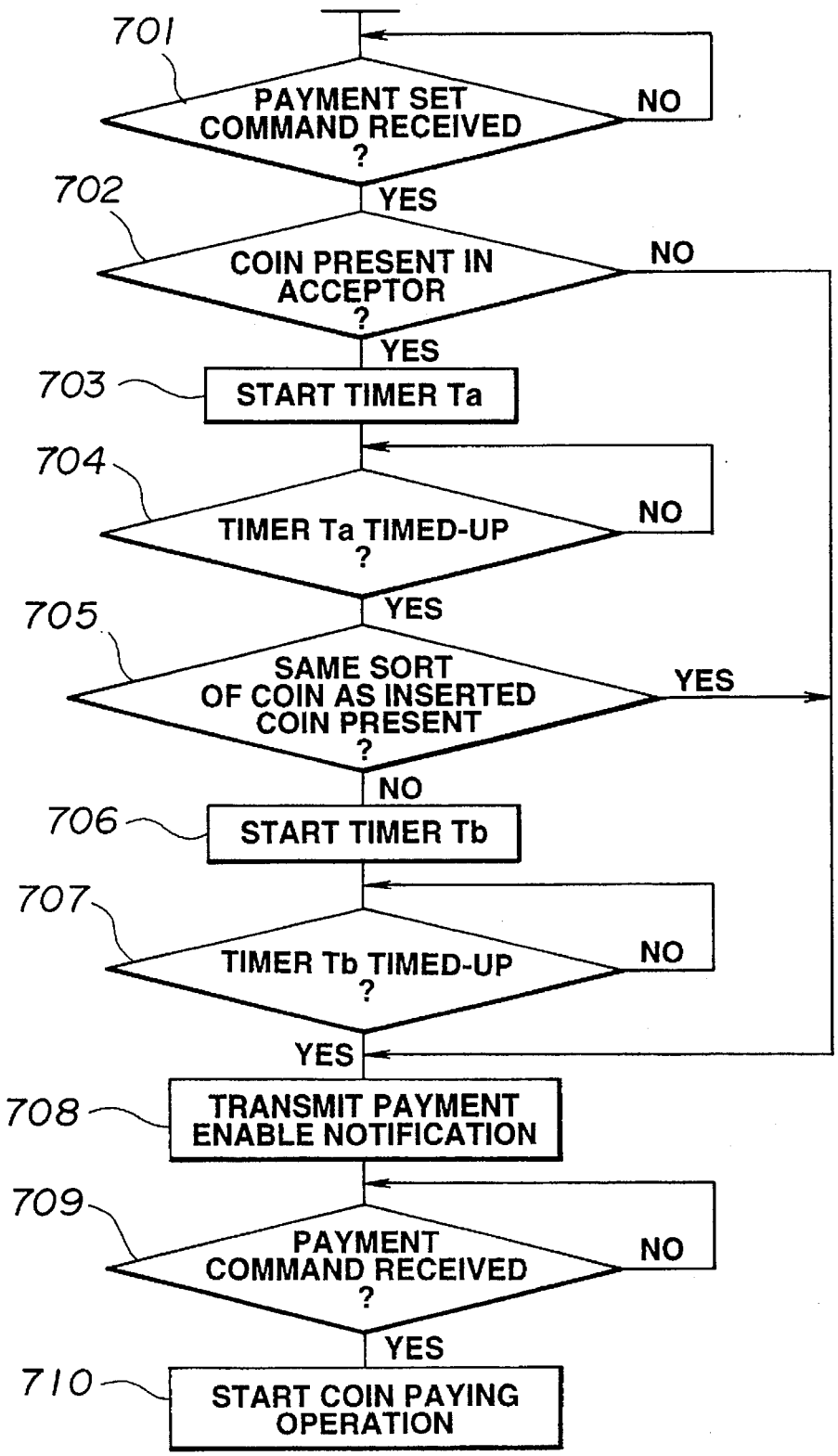
FIG. 12 is a flowchart for explaining the other change paying operation of the coin mech controller shown in FIG. 2.

Shown in FIG. 12 is a flowchart for explaining the change paying operation of the coin mech controller 70 having such an arrangement as mentioned above.

In this case, the coin mech controller 70 first examines whether the payment enable command from the main controller 10 ha been received (step 701). In the absence of a coin within the acceptor 100 (step 702), the control moves to a step 708 to transmit the payment enable notification to the main controller 10 (step 708). When receiving the payment command from the main controller 10 (step 709), the coin mech controller 70 starts its coin paying operation (step 710).

When determining in the step 702 the presence of a coin within the acceptor 100, the coin mech controller 70 causes the timer Ta to be started (step 703), so that, when the timer Ta times out (step 704), the coin mech controller 70 examines whether or not the coin having the same coin sort as the coin in the coin acceptor 100 is present in any of the coin tubes 210-1 to 210-4 (step 705). If it is present, then the control goes to the step 708 to transmit the payment enable notification to the main controller 10 (step 708). Reception of the payment command from the main controller 10 (step 709) causes the coin mech controller 70 to start its coin paying operation (step 710).

When judging in the step 705 that the coin having the same coin sort as the coin in the coin acceptor 100 is not present in any of the coin tubes 210-1 to 210-4, the coin mech controller 70 causes the timer Tb to be started (step 706). When the timer Tb times out (step 707), the coin mech controller 70 transmits the payment enable notification to the main controller 10 (step 708); whereas, when receiving the payment command from the main controller 10 (step 709), the coin mech controller 70 starts its coin paying operation (step 710).

Even with such an arrangement, as shown in FIG. 11, the start timing of the coin paying operation can be made, in most cases, faster than that of the prior art arrangement, which results in that the time necessary for the change payment can be minimized.

Although explanation has been made as to the change paying operation in the foregoing embodiment, the start timing of the coin paying operation can be made faster than that of the prior art arrangement even in the coin returning operation, whereby the time necessary for the coin returning can be minimized.

In this way, in accordance with the foregoing embodiment, the coin mech controller, when receiving the coin payment set command, judges the presence or absence of a coin within the coin discriminator/distributor and, when judging the absence of any coin within the coin discriminator/distributor, immediately performs its coin paying operation and, when judging the presence of a coin within the coin discriminator/distributor, starts its coin paying operation after the coin within the coin discriminator/distributor has passed through the coin discriminator/distributor. As a result, the time necessary for the coin payment can advantageously be minimized.

In accordance with the present invention, the coin dispenser 220 is arranged to allow simultaneous payment of 2 or 3 coins of a plurality of coin sorts; while the coin mech controller 70 shown in FIG. 1 is arranged so that, when receiving, e.g., information indicative of a change payment amount from the main controller 10, the coin mech controller 70 determines a payment pattern for payment of coins corresponding to the received change payment amount to pay out coins from the coin tubes 210-1 to 210-4 according to the payment pattern.

Figure 13:
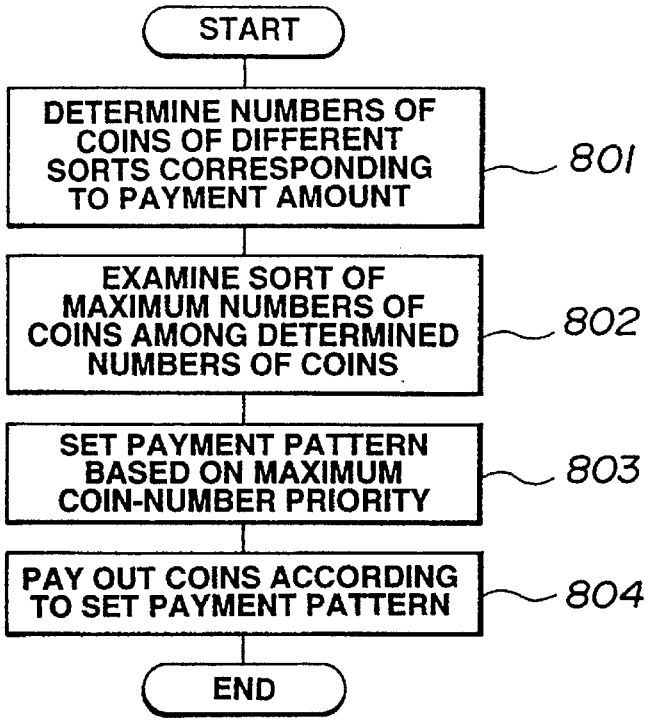
FIG. 13 is a flowchart for explaining the coin paying operation of the coin mech controller shown in FIG. 2.

FIG. 13 shows a flowchart for explaining the coin payment controlling operation of the coin mech controller 70. In FIG. 13, when receiving information indicative of a payment amount from the main controller 10, the coin mech controller 70 determines the numbers of coins having different sorts and corresponding to the payment amount (step 801). The determination of the numbers of different sorts of coins is carried out by looking up the payment amount and the residual amounts of coins within the coin tubes 210-1 to 210-4, i.e., the outputs of the empty sensors 212-1 to 212-4.

The coin mech controller 70 next examines the sort of the maximum numbers of coins among the numbers of coins determined in the step 801 (step 802), and determines a payment pattern based on the maximum coin-number priority (step 803).

When determining in the step 803 the payment pattern based on the maximum coin-number priority, the coin mech controller 70 controls the coin dispenser 220 according to the determined payment pattern to pay out the corresponding coins from the coin tubes 210-1 to 210-4.

For example, when change corresponding to a total of 790 yen is to be paid out and the numbers of coins in different sorts corresponding to the payment amount are determined in the step 801 as follows as already explained earlier in connection with the prior art, the sort of maximum one of the numbers of coins to be paid is found in the step 802 to be 10 yen.

| | |
|---|---|
| 500 yen coin | one |
| 100 yen coin | two |
| 50 yen coin | one |
| 10 yen coin | four |

In this case, when the number of simultaneously payable coins in the coin dispenser 220 is 3, a payment pattern based on 10-yen coin-number priority is determined in the step 803, as follows.

| | | | |
|---|---|---|---|
| First | 500 yen | 100 yen | 10 yen |
| Second | 100 yen | 50 yen | 10 yen |
| Third | 10 yen | | |
| Fourth | 10 yen | | |

Thus the coin mech controller 70 controls the coin dispenser 220 according to the payment pattern to pay out the corresponding coins.

That is, in the payment pattern based on the high-value coin priority in the prior art, 5 paying operations are required under the same conditions as already explained earlier; whereas, in the above payment pattern of the present embodiment, 4 paying operations are required to complete the change payment, whereby the change payment time can be reduced.

In the case where the number of simultaneously payable coins is 2, a payment pattern based on 10 yen coin-number priority is determined in the step 803, which follows.

| | | |
|---|---|---|
| First | 100 yen | 10 yen |
| Second | 100 yen | 10 yen |
| Third | 500 yen | 10 yen |
| Fourth | 50 yen | 10 yen |

Thus, the coin mech controller 70 controls the coin dispenser 220 according to the above payment pattern to pay out the corresponding coins.

That is, in the payment pattern based on the high-value coin priority in the prior art, 6 paying operations are required under the same conditions as already explained earlier; whereas, in the above payment pattern of the present embodiment, 4 paying operations are required to complete the change payment, whereby the change payment time can be reduced.

As has been explained in the foregoing, in accordance with the foregoing embodiment, since the numbers of coins in different sorts to be paid are examined and coins having the maximum one of the numbers of coins to be paid are preferentially firstly paid, the time necessary for the coin payment in the coin paying machine allowing simultaneous payment of a plurality of sorts of coins can advantageously be made shorter than that of the prior art machine.

What is claimed is:

1. A coin processor comprising:

coin discrimination means for discriminating whether a passing coin is true or false and generating a true or false signal representative of such discrimination;

true/false distribution means, located at a disposition position downstream of said coin discrimination means, for directing a passing coin to a true pathway or a false pathway, the pathway being chosen by said true/false distribution means according to said true or false signal from said coin discrimination means; and control means for overriding control of said true/false distribution means;

said control means controlling said true/false distribution means to direct coins to said false pathway if a succeeding coin has arrived at said coin discrimination means before a preceding coin has arrived at said disposition position, thus sending both the preceding and succeeding coins to said false pathway;

said control means including a timer means for counting a first time, slightly shorter than a time known to be necessary for the preceding coin to pass from said coin discrimination means to said disposition position, and for counting a second time, slightly longer than a time known to be necessary for the preceding coin to pass from said coin discrimination means through said disposition position, said timer means counting said first time when said discrimination means discriminates the preceding coin to be a true coin, and counting said second time when said coin discrimination means discriminates the preceding coin to be a false coin;

said control means controlling said true/false distribution means to direct coins to said false pathway if the succeeding coin has arrived at said coin discrimination means before said timer means times out.

2. A coin processor comprising:

coin discrimination means for discriminating whether a passing coin is true or false and generating a true or false signal representative of such discrimination;

true/false distribution means, located at a disposition position downstream of said coin discrimination means, for directing a passing coin to a true pathway or a false pathway, the pathway being chosen by said true/false distribution means according to said true or false signal from said coin discrimination means; and control means for overriding control of said true/false distribution means;

said control means controlling said true/false distribution means to direct coins to said false pathway if a succeeding coin has arrived at said coin discrimination means immediately after a preceding coin, discriminated to be a true coin, has passed through said disposition position, thus sending the succeeding coin to said false pathway.

3. A coin processor as set forth in claim 2, wherein said control means includes a timer means for counting a time, slightly longer than a time known to be necessary for the preceding coin to pass from said coin discrimination means through said disposition position, said control means controlling said true/false distribution means to direct coins to said false pathway if the succeeding coin has arrived at said coin discrimination means before said timer means times out.

4. A coin processor comprising:

coin discrimination means for discriminating whether a passing coin is true or false and generating a true or false signal representative of such discrimination;

true/false distribution means, located at a disposition position downstream of said coin discrimination means, for directing a passing coin to a true pathway or a false pathway, the pathway being chosen by said true/false distribution means according to said true or false signal from said coin discrimination means; and control means for overriding control of said true/false distribution means;

said control means controlling said true/false distribution means to direct coins to said false pathway if a succeeding coin has arrived at said coin discrimination means before a preceding coin has arrived at said disposition position, thus sending both the preceding and succeeding coins to said false pathway;

said control means controlling said true/false distribution means to direct coins to said false pathway if a succeeding coin has arrived at said coin discrimination means immediately after a preceding coin, discriminated to be a true coin, has passed through said disposition position, thus sending the succeeding coin to said false pathway.

5. A coin processor as set forth in claim 4, wherein said control means comprises:

a first timer means for counting a first time, slightly shorter than a time known to be necessary for the preceding coin to pass from said coin discrimination means to said disposition position; and a second timer means for counting a second time, slightly longer than a time known to be necessary for the preceding coin to pass from said coin discrimination means through said disposition position;

said control means controlling said true/false distribution means to direct coins to said false pathway if the succeeding coin has arrived at said coin discrimination means before said first timer means times out, if said discrimination means discriminated the preceding coin to be a true coin;

said control means controlling said true/false distribution means to direct coins to said false pathway if the succeeding coin has arrived at said coin discrimination means before said second timer means times out, if said discrimination means discriminated the preceding coin to be a false coin.

6. A coin processor comprising:

coin discrimination means for discriminating whether a passing coin is true or false and generating a true or false signal representative of such discrimination;

true/false distribution means, located at a disposition position downstream of said coin discrimination means, for directing a passing coin to a true pathway or a false pathway, the pathway being chosen by said true/false distribution means according to said true or false signal from said coin discrimination means; and control means for overriding control of said true/false distribution means;

said control means controlling said true/false distribution means to direct coins to said false pathway if a succeeding coin has arrived at said coin discrimination means before a preceding coin, discriminated to be a false coin, has passed though said disposition position, thus sending the succeeding coin to said false pathway;

said control means including a timer means for counting a time, slightly longer than a time known to be necessary for the preceding coin to pass from said coin discrimination means through said disposition position, said control means controlling said true/false distribution means to direct coins to said false pathway if the succeeding coin has arrived at said coin discrimination means before said timer means times out.

* * * * *